US007852173B2

(12) United States Patent
Guan

(10) Patent No.: US 7,852,173 B2
(45) Date of Patent: Dec. 14, 2010

(54) REFLECTION-TYPE BANDPASS FILTER

(75) Inventor: Ning Guan, Sakura (JP)

(73) Assignee: Fujikura Ltd., Tokyo (JP)

( * ) Notice: Subject to any disclaimer, the term of this patent is extended or adjusted under 35 U.S.C. 154(b) by 161 days.

(21) Appl. No.: 11/867,378

(22) Filed: Oct. 4, 2007

(65) Prior Publication Data

US 2009/0072928 A1 Mar. 19, 2009

(30) Foreign Application Priority Data

Oct. 5, 2006 (JP) ..... 2006-274323

(51) Int. Cl.
*H01P 1/203* (2006.01)

(52) U.S. Cl. ..... 333/204

(58) Field of Classification Search ..... 333/202, 333/204, 166–168, 175, 176, 185, 238
See application file for complete search history.

(56) References Cited

U.S. PATENT DOCUMENTS

| | | | | |
|---|---|---|---|---|
| 2,411,555 | A | 11/1946 | Rogers | |
| 3,617,877 | A | 11/1971 | Hobson | |
| 4,371,853 | A | 2/1983 | Makimoto et al. | |
| 4,992,760 | A | 2/1991 | Takeda et al. | |
| 5,418,507 | A * | 5/1995 | Keane et al. | 333/202 |
| 5,525,953 | A | 6/1996 | Okada et al. | |
| 5,923,295 | A | 7/1999 | Nakano et al. | |
| 6,323,740 | B1 | 11/2001 | Ishikawa et al. | |
| 6,353,371 | B1 * | 3/2002 | Kadota et al. | 333/133 |
| 6,563,403 | B2 | 5/2003 | Kanba et al. | |
| 6,577,211 | B1 * | 6/2003 | Tsujiguchi | 333/204 |
| 6,603,376 | B1 | 8/2003 | Handforth et al. | |
| 6,686,808 | B1 | 2/2004 | Sugawara et al. | |
| 6,924,714 | B2 * | 8/2005 | Jain | 333/123 |
| 2005/0140472 | A1 | 6/2005 | Ko et al. | |
| 2006/0061438 | A1 | 3/2006 | Toncich | |
| 2006/0255886 | A1 | 11/2006 | Ninomiya et al. | |
| 2007/0159276 | A1 * | 7/2007 | Han et al. | 333/204 |
| 2007/0210880 | A1 * | 9/2007 | Bobier et al. | 333/193 |

FOREIGN PATENT DOCUMENTS

| | | | |
|---|---|---|---|
| CH | 663 690 | A5 | 12/1987 |
| CN | 1097082 | A | 1/1995 |
| JP | 56-64501 | A | 6/1981 |
| JP | 9-172318 | A | 6/1997 |
| JP | 9-232820 | A | 9/1997 |
| JP | 10-65402 | A | 3/1998 |
| JP | 10-242746 | A | 9/1998 |
| JP | 2000-4108 | A | 1/2000 |
| JP | 2000-101301 | | 4/2000 |
| JP | 2002-43810 | A | 2/2002 |
| SU | 1 728 904 | A1 | 4/1992 |

OTHER PUBLICATIONS

Huang, F., "Quasi-Transversal Synthesis of Microwave Chirped Filters", Electronics Letters, May 21, 1992, pp. 1062-1064, vol. 28, No. 11, IEE Stevenage, GB, XP000305900.

(Continued)

*Primary Examiner*—Benny Lee
*Assistant Examiner*—Gerald Stevens
(74) *Attorney, Agent, or Firm*—Sughrue Mion, PLLC

(57) ABSTRACT

This invention provides a reflection-type bandpass filter for ultra-wideband wireless data communication, in which are provided, on the surface of a dielectric substrate, a center conductor and side conductors, provided on both sides of the center conductor, securing a prescribed distance between conductors with non-conducting portions intervening therebetween. The center conductor width or the distances between conductors, or both, are distributed non-uniformly in a length direction of the center conductor.

12 Claims, 10 Drawing Sheets

OTHER PUBLICATIONS

Deng, et al., "Multiple-Mode Resonance Bands in Periodically Nonuniform Conductor-Backed Coplanar Waveguides", Microwave Conference, 1999 Asia Pacific Singapore Nov. 30-Dec. 3, 1999, Nov. 30, 1999, pp. 5-8, vol. 1, IEEE, Piscataway, NJ, USA, XP010374097.

Le Roy, et al., "Novel Circuit Models of Arbitrary-Shape Line: Application to Parallel Coupled Microstrip Filters with Suppression of Multi-Harmonic Responses", 2005 European Microwave Conference CNIT La Defense, Paris, France Oct. 4-6, 2005, Oct. 4, 2005, pp. 921-924, IEEE, Piscataway, NJ, USA, XP010903914.

Le Roy, et al., "The Continuously Varying Transmission-Line Technique—Application to Filter Design", IEEE Transactions on Microwave Theory and Techniques, Sep. 1999, pp. 1680-1687, vol. 47, No. 9, IEEE Service Center, Piscataway, NJ, US, XP011037721.

Le Roy, et al., "A New Design of Microwave Filters by Using Continuously Varying Transmission Lines", 1997 IEEE MTT-S Digest, Jun. 8, 1997, pp. 639-642, vol. 2, IEEE, New York, NY, USA, XP010228412.

A. V. Oppenheim and R. W. Schafer, "Discrete-time signal processing," pp. 465-478, Prenticehall, 1998.

G-B. Xiao, K. Yashiro, N, Guan, and S. Ohokawa, "An effective method for designing nonuniformly coupled transmission-line filters," IEEE Trans. Microwave Theory tech., vol. 49, pp. 1027-1031, Jun. 2001.

Y. Konishi, "Microwave integrated circuits," pp. 19-21, Marcel Dekker, 1991.

Gaobiao Xiao et al, "An Efficient Algorithm for Solving Zakharov-Shabat Inverse Scattering Problem", IEEE Transactions on Antennas and Propagation, Jun. 1, 2002, pp. 807-811, vol. 50, No. 6, IEEE.

Chen et al., "Design of a UWB low insertion loss bandpass filter with spurious response suppression," Microwave Journal, Feb. 2006, pp. 112-116, English.

Xiao et al., "A New Numerical Method for Synthesis of Arbitrarily Terminated Lossless Nonuniform Transmission Lines", IEEE Transactions on Microwave Theory and Techniques, Feb. 2001, pp. 369-376, vol. 49, No. 2, IEEE Service Center, Piscataway, NJ, US, XP011038268, English.

Xiao et al., "Impedance Matching for Complex Loads Through Nonuniform Transmission Lines", IEEE Transactions on Microwave Theory and Techniques, Jun. 2002, pp. 1520-1525, vol. 50, No. 6, IEEE Service Center, Piscataway, NJ, US, XP011076613, English.

Chang et al., "Wide-Band Equal-Ripple Filters in Nonuniform Transmission Lines", IEEE Transactions on Microwave Theory and Techniques, Apr. 2002, pp. 1114-1119, vol. 50, No. 4, IEEE Service Center, Piscataway, NJ, US, XP011076539, English.

Moreira et al., "Direct Synthesis of Microwave Filters Using Inverse Scattering Transmission-Line Matrix Method", IEEE Transactions on Microwave Theory and Techniques, Dec. 2000, pp. 2271-2276, vol. 48, No. 12, IEEE Service Center, Piscataway, NJ, US, XP011038181, English.

Pan et al., "Arbitrary Filter Design by Using Nonuniform Transmission Lines", IEEE Microwave and Guided Wave Letters, Feb. 1999, pp. 60-62, vol. 9, No. 2, IEEE, XP 011035415, English.

Yang et al., "Design of Dual Passband Filter Based on Zakharov-Shabat Inverse Scattering Problem", APMC2005 Proceedings, Dec. 4-7, 2005, pp. 1-3, IEEE, XP 10901861, English.

Tan et al., "Analysis and design of conductor-backed asymmetric coplanar waveguide lines using conformal mapping techniques and their application to end-coupled filters," IEICE Trans. Electron., Jul. 1999, pp. 1098-1103, vol. E82-C, No. 7, English.

Sun et al., "Guided-Wave Characteristics of Periodically Nonuniform Coupled Microstrip Lines-Even and Odd Modes" IEEE Transaction on Microwave Theory and Techniques, IEEE Service Center. Piscataway, NJ, US, vol. 53, No. 4 Apr. 2005, pp. 1221-1227, English.

Cheng et al., "Inverse Scattering of Nonuniform, Symmetrical Coupled Lines" IEEE Microwave and Guided Wave Letters, IEEE Inc, New York, US, vol. 8, No. 7, Jul. 1998, pp. 260-262, English.

Ma et al., "Experimentally investigating slow-wave transmission lines and filters based on conductor-backed backed CPW periodic cells" Microwave Symposium Digest, 2005 IEEE MTT-S International Long Beach, CA, USA Jun. 12-17, 2005, Piscataway, NJ, USA IEEE, Jun. 12, 2005, pp. 1653-1656, English.

Young et al., "Accurate non-uniform transmission line model and its application to the de-embedding of on-wafer measurements" IEE Proceedings H. Microwaves, Antennas & Propagation, Institution of Electrical Engineers. Stevenage , GB, vol. 148, No. 3, Jun. 11, 2001, pp. 153-156, XP006016881, English.

Boulejfen et al., "A robust and efficient method for the frequency domain analysis of non-uniform, lossy multi-line transmission structures" Microwave Symposium Digest, 1998 IEEE MTT-S International Baltimore, MD, USA Jun. 7-12, 1998, pp. 1763-1766, XP010290106, English.

Y. Konishi, "Microwave Integrated Circuits", 1991, pp. 9-11, Marcel Dekker, English.

Mirshekar-Syahkal et al., "Accurate Analysis of Tapered Planar Transmission Lines for Microwave Integrated Circuits", IEEE Transactions on Microwave Theory and Techniques, Feb. 1981, pp. 123-128, vol. 29, No. 2, IEEE, English.

Wang et al., "Ultra-Wideband Bandpass Filter with Hybrid Microstrip/CPW Structure", IEEE Microwave and Wireless Components Letters, Dec. 2005, pp. 844-846, vol. 15, No. 12, IEEE, English.

L. Vegni et al., "Tapered Stripline Embedded in Inhomogeneous Media as Microwave Matching Line", IEEE Transactions on Microwave Theory and Techniques, IEEE, May 2001, vol. 49, No. 5, pp. 970-978.

P. Ghanipour et al, "Suppression of Mode Coupling in Conductor-Backed Asymmetric Coplanar Strips Using Slow-Wave Electrodes", IEEE Microwave and Wireless Components Letters, May 2006, vol. 16, No. 5, 272-274.

J. Svacina, "Special Types of Coplanar Transmission Lines Suitable Up to mm-Wave bands," 6th Topical Meeting on Electrical Performance of Electronic Packaging, IEEE, Oct. 1997, pp. 99-102.

Y. Qian and E. Yamashita, "Additional Approximate formulas and Experimental Data on Micro-Coplanar Striplines," IEEE Transaction on Microwave Theory and Techniques, IEEE, Apr. 1990, vol. 38, No., 4, pp. 443-445.

Japanese Office Action issued in related Japanese Patent Application No. 2006-274324 with English language translation mailed Jun. 22, 2010.

Japanese Office Action issued in related Japanese Application No. 2006-274326 with English language translation, mailed Jun. 22, 2010.

Japanese Office Action issued in related Japanese Patent Application No. 2006-274327 with English translation, mailed Jun. 22, 2010.

* cited by examiner

REFLECTION-TYPE BANDPASS FILTER

This application claims priority from Japanese Patent Application No. 2006-274323, filed on Oct. 5, 2006, the entire contents of which are incorporated herein by reference.

BACKGROUND OF THE INVENTION

1. Field of the Invention

This invention relates to a reflection-type bandpass filter for use in ultra-wideband (UWB) wireless data communication.

2. Description of the Related Art

This invention relates to a reflection-type bandpass filter for use in ultra-wideband (hereafter "UWB") wireless data communication. By using this UWB reflection-type bandpass filter, U.S. Federal Communications Commission requirements for spectrum masks can be satisfied.

As technology of the prior art related to this invention, for example, the technology disclosed in the following references 1 through 10 is known.

Reference 1: Specification of U.S. Pat. No. 2,411,555

Reference 2: Japanese Unexamined Patent Application No. 56-64501

Reference 3: Japanese Unexamined Patent Application No. 9-172318

Reference 4: Japanese Unexamined Patent Application No. 9-232820

Reference 5: Japanese Unexamined Patent Application No. 10-65402

Reference 6: Japanese Unexamined Patent Application No. 10-242746

Reference 7: Japanese Unexamined Patent Application No. 2000-4108

Reference 8: Japanese Unexamined Patent Application No. 2000-101301

Reference 9: Japanese Unexamined Patent Application No. 2002-43810

Reference 10: A. V. Oppenheim and R. W. Schafer, "Discrete-time signal processing," pp. 465-478, Prentice Hall, 1998.

Reference 11: G-B. Xiao, K. Yashiro, N. Guan, and S. Ohokawa, "An effective method for designing nonuniformly coupled transmission-line filters," IEEE Trans. Microwave Theory Tech., vol. 49, pp. 1027-1031, June 2001.

Reference 12: Y. Konishi, "Microwave integrated circuits", pp. 19-21, Marcel Dekker, 1991

However, the bandpass filters proposed in the prior art may not satisfy the FCC specifications, due to manufacturing tolerances and other reasons.

Further, bandpass filters which use coplanar strips do not use wide ground strips, and so are not suitable for coupling with transmission lines such as slot lines.

This invention was devised in light of the above circumstances, and has as an object the provision of a high-performance UWB reflection-type bandpass filter which has excellent coupling characteristics with transmission lines such as slot lines, and which satisfies FCC specifications.

SUMMARY OF THE INVENTION

This invention provides a reflection-type bandpass filter for ultra-wideband wireless data communication, in which are provided on the surface of a dielectric substrate a center conductor and side conductors provided on both sides of the center conductor securing a prescribed distance between conductors with non-conducting portions intervening, and in which the center conductor width or the distances between conductors, or both, are distributed non-uniformly in a length direction of the center conductor.

In a reflection-type bandpass filter of this invention, the center conductor width may be constant, and the distances between conductors may be distributed non-uniformly.

Alternately, the distances between conductors may be constant, and the center conductor width may be distributed non-uniformly.

In a reflection-type bandpass filter of this invention, a difference of 10 dB or higher may exist between a reflectance in a ranges of frequencies f for which $f<3.1$ GHz and $f>10.6$ GHz, and a reflectance in a range of frequencies 3.9 GHz$\leqq f \leqq$9.8 GHz, and in a range 3.9 GHz$\leqq f \leqq$9.8 GHz a group delay variation may be within ±0.1 ns.

In a reflection-type bandpass filter of this invention, alternately, a difference of 10 dB or higher may exist between a reflectance in a range of frequencies f for which $f<3.1$ GHz and $f>10.6$ GHz, and a reflectance in a range of frequencies 3.7 GHz$\leqq f \leqq$10.0 GHz, and in a range 3.7 GHz$\leqq f \leqq$10.0 GHz a group delay variation may be within ±0.1 ns.

In a reflection-type bandpass filter of this invention, alternately, a difference of 10 dB or higher may exist between a reflectance in a range of frequencies f for which $f<3.1$ GHz and $f>10.6$ GHz, and a reflectance in a range of frequencies 4.1 GHz$\leqq f \leqq$9.5 GHz, and in a range 4.1 GHz$\leqq f \leqq$9.5 GHz a group delay variation may be within ±0.1 ns.

In a reflection-type bandpass filter of this invention, a characteristic impedance Zc of an input terminal transmission line may be in the range $10\Omega \leqq Zc \leqq 300\Omega$.

In a reflection-type bandpass filter of this invention, a resistance having the same impedance as the above characteristic impedance value, or a non-reflecting terminator, may be provided on the terminating side.

In a reflection-type bandpass filter of this invention, the center conductor and the side conductors may comprise metal plates of thickness equal to or greater than a skin depth of the metal plates at f=1 GHz.

In a reflection-type bandpass filter of this invention, the dielectric substrate may have a thickness h in a range 0.1 mm$\leqq h \leqq$10 mm, a relative permittivity $\in r$ in a range $1 \leqq \in r \leqq 500$, a width W in a range 2 mm$\leqq W \leqq$100 mm, and a length L in a range 2 mm$\leqq L \leqq$500 mm.

In a reflection-type bandpass filter of this invention, length-direction distributions of the center conductor width and of the distances between conductors may satisfy a design method based on the inverse problem of deriving a potential from spectral data in the Zakharov-Shabat equation.

In a reflection-type bandpass filter of this invention, length-direction distributions of the center conductor width and of the distances between conductors may satisfy a window function method.

In a reflection-type bandpass filter of this invention, length-direction distributions of the center conductor width and of the distances between conductors may satisfy a Kaiser window function method.

In a reflection-type bandpass filter of this invention, by applying a window function technique to design a reflection-type bandpass filter comprising non-uniform coplanar strips, the pass band can be made extremely broad and variation in group delay within the pass band can be made extremely small compared with filters of the related art, even when manufacturing tolerances are large. As a result, a UWB bandpass filter can be provided which satisfies FCC specifications.

Further, ground strips can be made wide, so that easy coupling with transmission lines such as slot lines is achieved.

Here, "ground strips" refers to the conductors on both sides, which are connected together on the input end.

DESCRIPTION OF THE PREFERRED EMBODIMENTS

Figure 1:
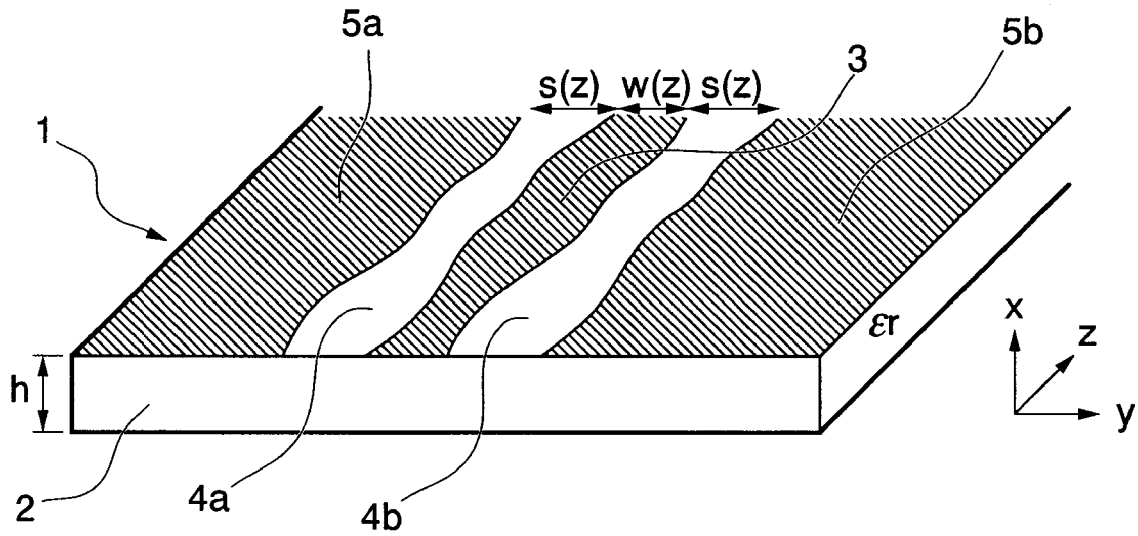
FIG. 1 is a perspective view showing one aspect of a reflection-type bandpass filter of the invention.

Below, exemplary aspects of the invention are explained referring to the drawings.

FIG. 1 is a perspective view showing, in summary, the configuration of a reflection-type bandpass filter of an exemplary aspect of this invention. In the figure, the symbol 1 is the reflection-type bandpass filter, 2 is a dielectric substrate, 3 is a center conductor, 4*a* and 4*b* are non-conducting portions, and 5*a* and 5*b* are side conductors.

In the reflection-type bandpass filter 1 of this aspect, the center conductor 3 and side conductors 5*a*, 5*b* provided on either side of the center conductor 3, maintaining a prescribed distance between conductors and with non-conducting portions 4*a*, 4*b* intervening, are formed on the surface of the dielectric substrate 2; the non-uniform coplanar strips are such that the center conductor width or the distances between conductors, or both, are distributed non-uniformly in the length direction of the center conductor 3.

As shown in FIG. 1, the z axis is taken along the length direction of the center conductor 3, the y axis is taken in the direction perpendicular to the z axis and parallel to the surface of the substrate 2, and the x axis is taken in the direction perpendicular to the y axis and to the z axis. The length extending in the z axis direction from the end face on the input end is z. In the reflection-type bandpass filter 1, the conductor-to-conductor distance between the side conductor 5*a* and the center conductor 3, and the conductor-to-conductor distance between the side conductor 5*b* and the center conductor 3, are the same at each place where z is equal (hereafter the "distance between conductors s"). In this reflection-type bandpass filter, the side conductors 5*a* and 5*b* are semi-infinite: in other words, the widths of the side conductors 5*a* and 5*b* are ten times or greater than the width of the center conductor 3 and the non-conducting portions 4*a*, 4*b*. Hence the side conductors 5*a*, 5*b* can be used in configuring a slot line, slot antenna, or the like. Moreover, compared with symmetric-type two-conductor coplanar strips (coplanar strips in which two conductors of equal width are arranged symmetrically), the characteristic impedance of this reflection-type bandpass filter is low, so that the substrate 2 can be fabricated from material with a low permittivity.

A reflection-type bandpass filter of this aspect of the invention adopts a configuration in which stop band rejection (the difference between the reflectance in the pass band, and the reflectance in the stop band) is increased, by using a window function method (see Reference 10) employed in digital filter design. By this means, instead of expansion of the transition frequency region (the region between the pass band boundary and the stop band boundary), the stop band rejection can be increased. As a result, manufacturing tolerances can be increased. Also, variation in the group delay within the pass band is decreased.

Figure 19:
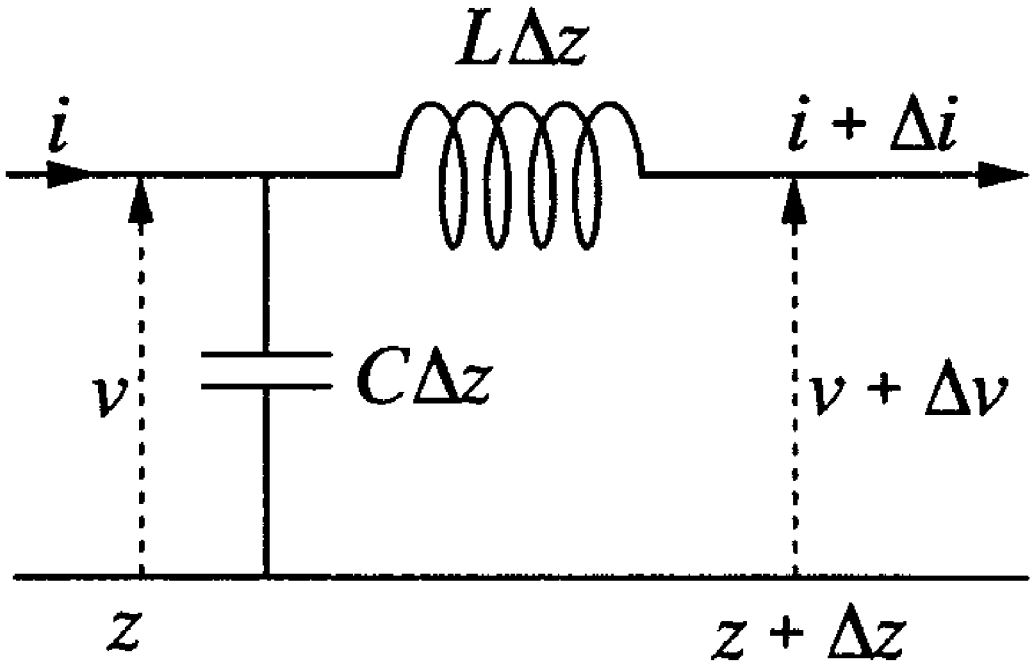

The transmission line of a reflection-type bandpass filter 1 of this aspect of the invention can be represented by a non-uniformly distributed constant circuit such as in FIG. 19.

From FIG. 19, the following equation (1) is obtained for the line voltage v(z,t) and the line current i(z,t).

$$\begin{cases} -\dfrac{\partial v(z,t)}{\partial z} = L(z)\dfrac{\partial i(z,t)}{\partial t}, \\ -\dfrac{\partial i(z,t)}{\partial z} = C(z)\dfrac{\partial v(z,t)}{\partial t}. \end{cases} \quad \text{(equation 1)}$$

Here L(z) and C(z) are the inductance and capacitance respectively per unit length in the transmission line. Here, the function of equation (2) is introduced.

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{(equation 2)}$$

Here $Z(z)=\sqrt{\{L(z)/C(z)\}}$ is the local characteristic impedance, and $\phi_1$, $\phi_2$ are the power wave amplitudes propagating in the +z and −z directions respectively.

Substitution into equation (1) yields equation (3).

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{(equation 3)}$$

Here $c(z)=1/\sqrt{\{L(z)/C(z)\}}$. If the time factor is set to exp ($j\omega t$), and a variable transformation is performed as in equation (4) below, then the Zakharov-Shabat equation of equation (5) is obtained.

$$x(z) = \int_0^z \frac{ds}{c(s)} \quad \text{(equation 4)}$$

$$\begin{cases} \dfrac{\partial \phi_1(x)}{\partial x} + j\omega\phi_1(x) = -q(x)\phi_2(x), \\ \dfrac{\partial \phi_2(x)}{\partial x} - j\omega\phi_2(x) = -q(x)\phi_1(x). \end{cases} \quad \text{(equation 5)}$$

Here q(x) is as given by equation (6) below.

$$q(x) = \frac{1}{2}\frac{d\ln Z(x)}{dx}. \quad \text{(equation 6)}$$

The Zakharov-Shabat inverse problem involves synthesizing the potential q(x) from spectral data which is a solution satisfying the above equations (see Reference 11). If the potential q(x) is found, the local characteristic impedance Z(x) is determined as in equation (7) below.

$$Z(x) = Z(0)\exp\left[2\int_0^x q(s)ds\right]. \quad \text{(equation 7)}$$

Here, normally in a process to determine the potential q(x), the reflectance coefficient r(x) in x space is calculated from the spectra data reflectance coefficient R(ω) using the following equation (8), and q(x) are obtained from r(x).

$$r(x) = \frac{1}{2\pi}\int_{-\infty}^{\infty} R(\omega)e^{-j\omega x}d\omega \quad \text{(equation 8)}$$

In this invention, in place of obtaining r(x) from the R(ω) for ideal spectral data, a window function is applied as in equation (9) to determine r'(x).

$$r'(x)=w(x)r(x). \quad \text{(equation 9)}$$

Here ω(x) is the window function. If the window function is selected appropriately, the stop band rejection level can be appropriately controlled. Here, a Kaiser window is used as an example. The Kaiser window is defined as in equation (10) below (see Reference 10).

$$w[n] = \begin{cases} \dfrac{I_0\left[\beta(1-[(n-\alpha)/\alpha]^2)^{1/2}\right]}{I_0(\beta)}, & 0 \le n \le M, \\ 0, & \text{otherwise} \end{cases} \quad \text{(equation 10)}$$

Here $\alpha=M/s$, and β is determined empirically as in equation (11) below.

$$\beta = \begin{cases} 0.1102(A-8.7), & A > 50, \\ 0.5842(A-21)^{0.4} + 0.07886(A-21), & 21 \le A \le 50, \\ 0, & A < 21 \end{cases} \quad \text{(equation 11)}$$

Here $A=-20\log_{10}\delta$. where δ is the peak approximation error in the pass band and in the stop band.

In this way q(x) is determined, and from equation (7) the local characteristic impedance Z(x) is determined.

Here, when either the width w of the center conductor 6 (hereafter the "center conductor width w") or the distance between conductors s, or both, of the coplanar strips are varied, the characteristic impedance can be changed (see Reference 12).

Figure 2:
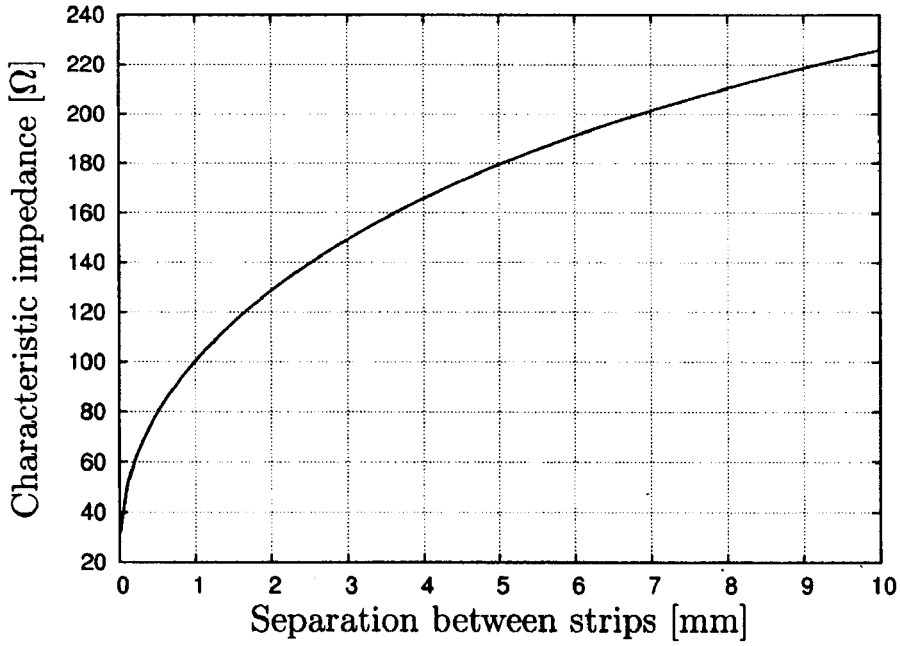
FIG. 2 is a graph showing the conductor-to-conductor distance dependence of the characteristic impedance in the coplanar strips.
Figure 3:
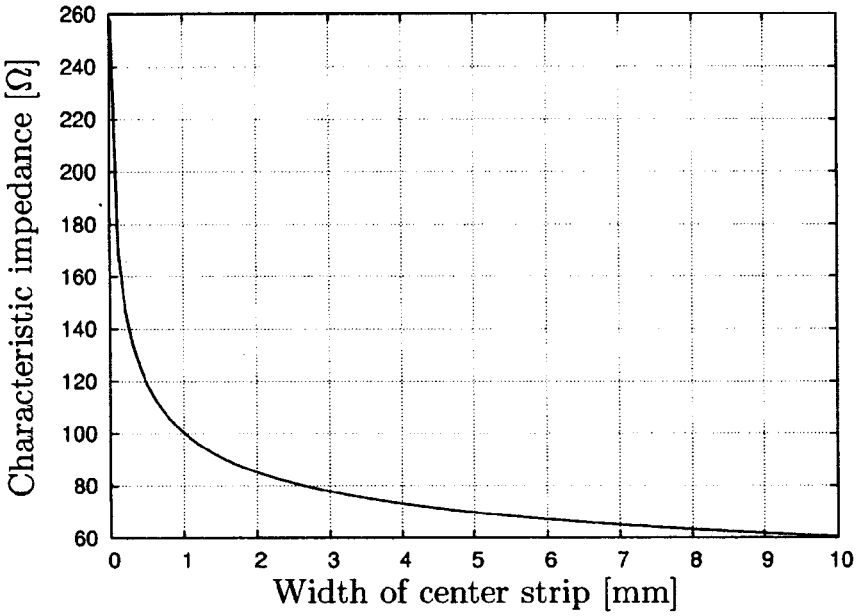
FIG. 3 is a graph showing the center conductor width dependence of the characteristic impedance in the coplanar strips.

FIG. 2 shows the dependence of the characteristic impedance on the distance between conductors s, when the center conductor width w=1 mm, the thickness of the substrate 2 is 1 mm, and the relative permittivity $\in_r$ of the substrate 2 is 4. FIG. 3 shows the dependence of the characteristic impedance on the center conductor width w, when the distance between conductors s=1 mm, h=1 mm, and $\in_r$=4.

In this invention, the center conductor width w or distance between conductors s was calculated based on the local characteristic impedance obtained from equation (7), and a bandpass filter 1 was manufactured so as to satisfy the calculated center conductor width w or distance between conductors s. By this means, reflection-type bandpass filters 1 having the desired pass band were obtained.

Below, the invention is explained in further detail referring to embodiments. Each of the embodiments described below is merely an illustration of the invention, and the invention is in no way limited to these embodiment descriptions.

Embodiment 1

A Kaiser window was used for which the reflectance is 0.9 at frequencies f in the range 3.4 GHz≦f≦10.3 GHz, and is 0 elsewhere, and for which A=30. Design was performed using one wavelength of signals at a frequency f=1 GHz propagating in the coplanar strip as the waveguide length, and setting the system characteristic impedance to 75Ω. Here, the characteristic impedance is set so as to match the impedance of the system being used. In general, in a circuit which handles high-frequency signals, a system impedance of 50Ω, 75Ω, 300Ω, or similar is used. It is desirable that the characteristic impedance Zc be in the range 10Ω≦Zc≦300Ω. If the characteristic impedance is smaller than 10Ω, then losses due to the conductor and dielectric become comparatively large. If the characteristic impedance is higher than 300Ω, matching with the system impedance is not possible.

Figure 4:
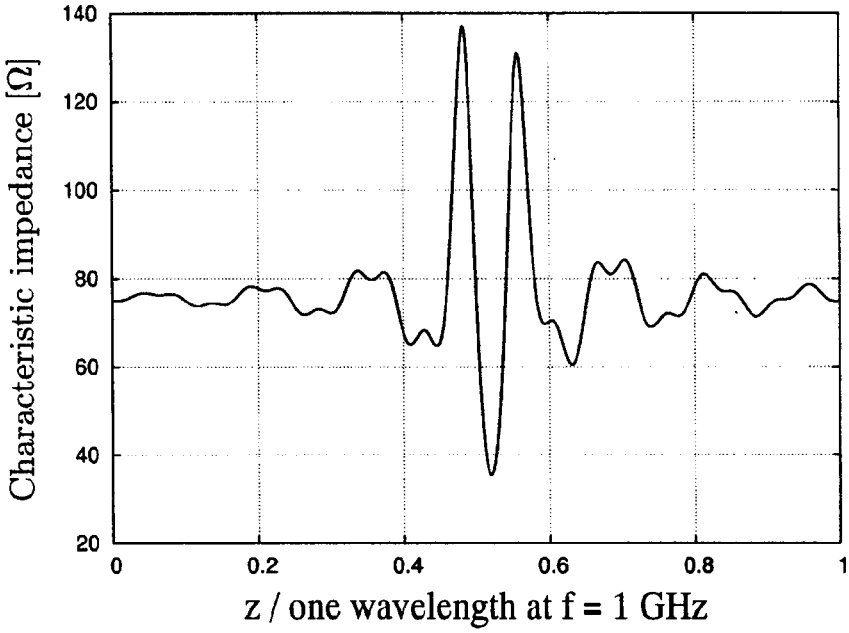
FIG. 4 is a graph showing the characteristic impedance distribution of the reflection-type bandpass filter fabricated in Embodiment 1.

FIG. 4 shows the distribution in the z-axis direction of the local characteristic impedance obtained in the inverse problem. The horizontal axis is z divided by one wavelength at f=1 GHz; similar axes are used in FIG. 9 and FIG. 14 below.

Figure 5:
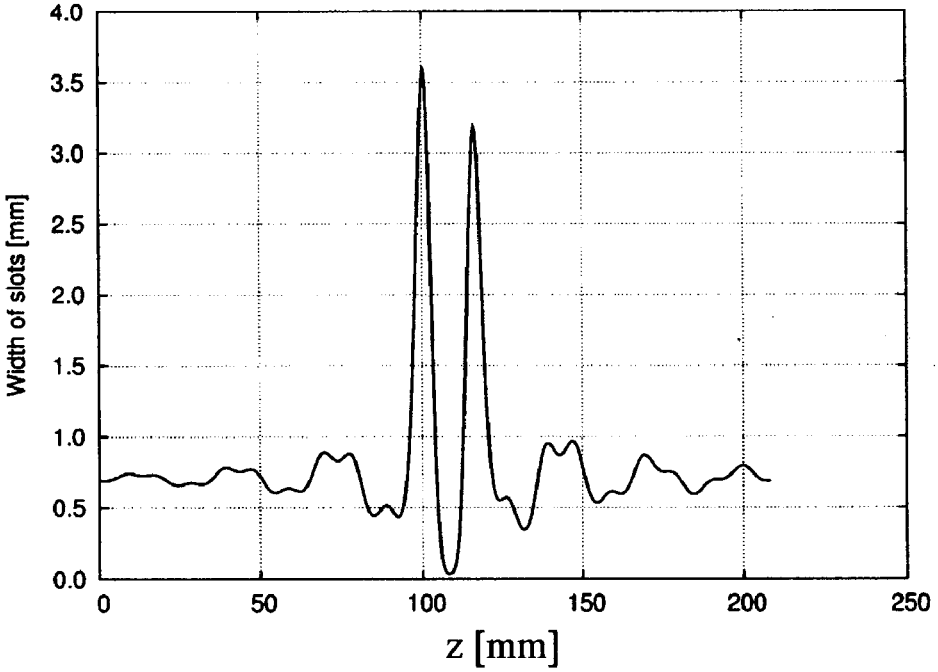
FIG. 5 is a graph showing the distribution of the distance between conductors of the coplanar strip in the reflection-type bandpass filter fabricated in Embodiment 1.

FIG. 5 shows the distribution in the z-axis direction of the distance between conductors s, when using a substrate 2 with a thickness h=1 mm and relative permittivity $\in_r$=4, and when the center conductor width w=2 mm. Tables 1 through 3 list the distances between conductors s.

TABLE 1

Distances between conductors (1/3)

| | z[mm] | | | | | | | | | | | |
|---|---|---|---|---|---|---|---|---|---|---|---|---|
| | 0.00 | 0.21 | 0.41 | 0.62 | 0.83 | 1.04 | 1.24 | 1.45 | 1.66 | 1.87 | 2.07 | 2.28 |
| | s[mm] | | | | | | | | | | | |
| | 0.69 | 0.69 | 0.69 | 0.69 | 0.69 | 0.69 | 0.69 | 0.69 | 0.69 | 0.69 | 0.69 | 0.69 |
| #2 | 2.49 | 2.70 | 2.90 | 3.11 | 3.32 | 3.53 | 3.73 | 3.94 | 4.15 | 4.36 | 4.56 | 4.77 |
| — | 0.69 | 0.69 | 0.69 | 0.69 | 0.69 | 0.70 | 0.70 | 0.70 | 0.70 | 0.70 | 0.70 | 0.71 |
| #3 | 4.98 | 5.19 | 5.39 | 5.60 | 5.81 | 6.02 | 6.23 | 6.43 | 6.64 | 6.85 | 7.06 | 7.26 |
| — | 0.71 | 0.71 | 0.71 | 0.72 | 0.72 | 0.72 | 0.72 | 0.72 | 0.73 | 0.73 | 0.73 | 0.73 |
| #4 | 7.47 | 7.68 | 7.89 | 8.10 | 8.31 | 8.51 | 8.72 | 8.93 | 9.14 | 9.35 | 9.55 | 9.76 |
| — | 0.73 | 0.74 | 0.74 | 0.74 | 0.74 | 0.74 | 0.74 | 0.74 | 0.74 | 0.74 | 0.74 | 0.74 |
| #5 | 9.97 | 10.18 | 10.39 | 10.59 | 10.80 | 11.01 | 11.22 | 11.43 | 11.63 | 11.84 | 12.05 | 12.26 |
| — | 0.74 | 0.74 | 0.74 | 0.74 | 0.74 | 0.73 | 0.73 | 0.73 | 0.73 | 0.73 | 0.73 | 0.73 |
| #6 | 12.47 | 12.67 | 12.88 | 13.09 | 13.30 | 13.51 | 13.71 | 13.92 | 14.13 | 14.34 | 14.55 | 14.75 |
| — | 0.73 | 0.73 | 0.73 | 0.73 | 0.73 | 0.73 | 0.73 | 0.73 | 0.73 | 0.73 | 0.73 | 0.73 |
| #7 | 14.96 | 15.17 | 15.38 | 15.58 | 15.79 | 16.00 | 16.21 | 16.42 | 16.62 | 16.83 | 17.04 | 17.25 |
| — | 0.73 | 0.73 | 0.73 | 0.73 | 0.73 | 0.73 | 0.73 | 0.73 | 0.73 | 0.73 | 0.73 | 0.73 |
| #8 | 17.46 | 17.66 | 17.87 | 18.08 | 18.29 | 18.50 | 18.70 | 18.91 | 19.12 | 19.33 | 19.54 | 19.74 |
| — | 0.73 | 0.73 | 0.73 | 0.73 | 0.73 | 0.72 | 0.72 | 0.72 | 0.72 | 0.71 | 0.71 | 0.71 |
| #9 | 19.95 | 20.16 | 20.37 | 20.57 | 20.78 | 20.99 | 21.19 | 21.40 | 21.61 | 21.82 | 22.02 | 22.23 |
| — | 0.70 | 0.70 | 0.70 | 0.69 | 0.69 | 0.69 | 0.68 | 0.68 | 0.68 | 0.67 | 0.67 | 0.67 |
| #10 | 22.44 | 22.64 | 22.85 | 23.06 | 23.27 | 23.47 | 23.68 | 23.89 | 24.09 | 24.30 | 24.51 | 24.71 |
| — | 0.67 | 0.66 | 0.66 | 0.66 | 0.66 | 0.66 | 0.66 | 0.66 | 0.66 | 0.66 | 0.66 | 0.66 |
| #11 | 24.92 | 25.13 | 25.33 | 25.54 | 25.75 | 25.96 | 26.16 | 26.37 | 26.58 | 26.78 | 26.99 | 27.20 |
| — | 0.66 | 0.66 | 0.66 | 0.66 | 0.66 | 0.66 | 0.66 | 0.67 | 0.67 | 0.67 | 0.67 | 0.67 |
| #12 | 27.41 | 27.61 | 27.82 | 28.03 | 28.23 | 28.44 | 28.65 | 28.86 | 29.06 | 29.27 | 29.48 | 29.68 |
| — | 0.67 | 0.67 | 0.67 | 0.67 | 0.67 | 0.67 | 0.67 | 0.67 | 0.67 | 0.67 | 0.67 | 0.67 |
| #13 | 29.89 | 30.10 | 30.31 | 30.51 | 30.72 | 30.93 | 31.13 | 31.34 | 31.55 | 31.75 | 31.96 | 32.17 |
| — | 0.67 | 0.67 | 0.67 | 0.67 | 0.67 | 0.67 | 0.67 | 0.67 | 0.67 | 0.66 | 0.67 | 0.67 |
| #14 | 32.38 | 32.58 | 32.79 | 33.00 | 33.20 | 33.41 | 33.62 | 33.83 | 34.03 | 34.24 | 34.45 | 34.65 |
| — | 0.67 | 0.67 | 0.67 | 0.67 | 0.67 | 0.67 | 0.68 | 0.68 | 0.68 | 0.69 | 0.69 | 0.69 |
| #15 | 34.86 | 35.07 | 35.28 | 35.49 | 35.69 | 35.90 | 36.11 | 36.32 | 36.53 | 36.73 | 36.94 | 37.15 |
| — | 0.70 | 0.70 | 0.71 | 0.71 | 0.72 | 0.72 | 0.73 | 0.74 | 0.74 | 0.75 | 0.75 | 0.76 |
| #16 | 37.36 | 37.57 | 37.78 | 37.98 | 38.19 | 38.40 | 38.61 | 38.82 | 39.03 | 39.24 | 39.44 | 39.65 |
| — | 0.76 | 0.76 | 0.77 | 0.77 | 0.77 | 0.78 | 0.78 | 0.78 | 0.78 | 0.78 | 0.78 | 0.78 |
| #17 | 39.86 | 40.07 | 40.28 | 40.49 | 40.70 | 40.90 | 41.11 | 41.32 | 41.53 | 41.74 | 41.95 | 42.16 |
| — | 0.78 | 0.78 | 0.78 | 0.78 | 0.77 | 0.77 | 0.77 | 0.77 | 0.77 | 0.76 | 0.76 | 0.76 |
| #18 | 42.36 | 42.57 | 42.78 | 42.99 | 43.20 | 43.41 | 43.61 | 43.82 | 44.03 | 44.24 | 44.45 | 44.66 |
| — | 0.76 | 0.76 | 0.76 | 0.75 | 0.75 | 0.75 | 0.75 | 0.75 | 0.75 | 0.75 | 0.76 | 0.76 |
| #19 | 44.86 | 45.07 | 45.28 | 45.49 | 45.70 | 45.91 | 46.11 | 46.32 | 46.53 | 46.74 | 46.95 | 47.16 |
| — | 0.76 | 0.76 | 0.76 | 0.76 | 0.76 | 0.77 | 0.77 | 0.77 | 0.77 | 0.77 | 0.77 | 0.77 |
| #20 | 47.37 | 47.57 | 47.78 | 47.99 | 48.20 | 48.41 | 48.62 | 48.82 | 49.03 | 49.24 | 49.45 | 49.66 |
| — | 0.77 | 0.77 | 0.77 | 0.76 | 0.76 | 0.76 | 0.76 | 0.75 | 0.75 | 0.74 | 0.73 | 0.73 |
| #21 | 49.86 | 50.07 | 50.28 | 50.49 | 50.70 | 50.90 | 51.11 | 51.32 | 51.52 | 51.73 | 51.94 | 52.14 |
| — | 0.72 | 0.71 | 0.71 | 0.70 | 0.69 | 0.68 | 0.68 | 0.67 | 0.66 | 0.66 | 0.65 | 0.64 |
| #22 | 52.35 | 52.56 | 52.76 | 52.97 | 53.18 | 53.38 | 53.59 | 53.79 | 54.00 | 54.21 | 54.41 | 54.62 |
| — | 0.64 | 0.63 | 0.63 | 0.62 | 0.62 | 0.61 | 0.61 | 0.61 | 0.61 | 0.60 | 0.60 | 0.60 |
| #23 | 54.83 | 55.03 | 55.24 | 55.44 | 55.65 | 55.86 | 56.06 | 56.27 | 56.48 | 56.68 | 56.89 | 57.09 |
| — | 0.60 | 0.61 | 0.61 | 0.61 | 0.61 | 0.61 | 0.61 | 0.62 | 0.62 | 0.62 | 0.62 | 0.63 |
| #24 | 57.30 | 57.51 | 57.71 | 57.92 | 58.13 | 58.33 | 58.54 | 58.75 | 58.95 | 59.16 | 59.37 | 59.57 |
| — | 0.63 | 0.63 | 0.63 | 0.63 | 0.64 | 0.64 | 0.64 | 0.64 | 0.64 | 0.64 | 0.63 | 0.63 |
| #25 | 59.78 | 59.99 | 60.19 | 60.40 | 60.61 | 60.81 | 61.02 | 61.23 | 61.43 | 61.64 | 61.84 | 62.05 |
| — | 0.63 | 0.63 | 0.63 | 0.63 | 0.62 | 0.62 | 0.62 | 0.62 | 0.62 | 0.62 | 0.61 | 0.61 |
| #26 | 62.26 | 62.46 | 62.67 | 62.88 | 63.08 | 63.29 | 63.49 | 63.70 | 63.91 | 64.11 | 64.32 | 64.53 |
| — | 0.61 | 0.61 | 0.62 | 0.62 | 0.62 | 0.62 | 0.63 | 0.63 | 0.64 | 0.65 | 0.65 | 0.66 |
| #27 | 64.74 | 64.94 | 65.15 | 65.36 | 65.57 | 65.77 | 65.98 | 66.19 | 66.40 | 66.61 | 66.82 | 67.02 |
| — | 0.67 | 0.68 | 0.69 | 0.70 | 0.71 | 0.73 | 0.74 | 0.75 | 0.76 | 0.78 | 0.79 | 0.80 |
| #28 | 67.23 | 67.44 | 67.65 | 67.86 | 68.07 | 68.28 | 68.49 | 68.70 | 68.91 | 69.12 | 69.33 | 69.54 |
| — | 0.81 | 0.83 | 0.84 | 0.85 | 0.86 | 0.86 | 0.87 | 0.88 | 0.88 | 0.89 | 0.89 | 0.89 |
| #29 | 69.75 | 69.96 | 70.17 | 70.38 | 70.59 | 70.80 | 71.01 | 71.22 | 71.43 | 71.64 | 71.85 | 72.06 |
| — | 0.89 | 0.89 | 0.89 | 0.89 | 0.88 | 0.88 | 0.87 | 0.87 | 0.86 | 0.86 | 0.85 | 0.85 |

TABLE 1-continued

| Distances between conductors (1/3) | | | | | | | | | | | | |
|---|---|---|---|---|---|---|---|---|---|---|---|---|
| | z[mm] | | | | | | | | | | | |
| | 0.00 | 0.21 | 0.41 | 0.62 | 0.83 | 1.04 | 1.24 | 1.45 | 1.66 | 1.87 | 2.07 | 2.28 |
| | s[mm] | | | | | | | | | | | |
| | 0.69 | 0.69 | 0.69 | 0.69 | 0.69 | 0.69 | 0.69 | 0.69 | 0.69 | 0.69 | 0.69 | 0.69 |
| #30 | 72.27 | 72.48 | 72.69 | 72.90 | 73.11 | 73.32 | 73.53 | 73.74 | 73.95 | 74.16 | 74.37 | 74.58 |
| — | 0.84 | 0.84 | 0.84 | 0.83 | 0.83 | 0.83 | 0.83 | 0.83 | 0.83 | 0.83 | 0.83 | 0.83 |

TABLE 2

| Distances between conductors (2/3) | | | | | | | | | | | | |
|---|---|---|---|---|---|---|---|---|---|---|---|---|
| #31 | 74.78 | 74.99 | 75.20 | 75.41 | 75.62 | 75.83 | 76.04 | 76.25 | 76.46 | 76.67 | 76.88 | 77.09 |
| — | 0.84 | 0.84 | 0.84 | 0.85 | 0.85 | 0.86 | 0.86 | 0.87 | 0.87 | 0.87 | 0.88 | 0.88 |
| #32 | 77.30 | 77.51 | 77.72 | 77.93 | 78.14 | 78.35 | 78.56 | 78.77 | 78.98 | 79.19 | 79.40 | 79.61 |
| — | 0.88 | 0.88 | 0.88 | 0.88 | 0.87 | 0.86 | 0.86 | 0.85 | 0.84 | 0.82 | 0.81 | 0.79 |
| #33 | 79.82 | 80.03 | 80.23 | 80.44 | 80.65 | 80.86 | 81.06 | 81.27 | 81.48 | 81.68 | 81.89 | 82.09 |
| — | 0.78 | 0.76 | 0.74 | 0.72 | 0.70 | 0.68 | 0.66 | 0.64 | 0.62 | 0.60 | 0.58 | 0.56 |
| #34 | 82.30 | 82.50 | 82.71 | 82.91 | 83.12 | 83.32 | 83.53 | 83.73 | 83.93 | 84.14 | 84.34 | 84.54 |
| — | 0.55 | 0.53 | 0.52 | 0.50 | 0.49 | 0.48 | 0.47 | 0.46 | 0.46 | 0.45 | 0.45 | 0.44 |
| #35 | 84.75 | 84.95 | 85.16 | 85.36 | 85.56 | 85.77 | 85.97 | 86.17 | 86.38 | 86.58 | 86.79 | 86.99 |
| — | 0.44 | 0.44 | 0.44 | 0.44 | 0.45 | 0.45 | 0.45 | 0.46 | 0.46 | 0.47 | 0.48 | 0.48 |
| #36 | 87.20 | 87.40 | 87.60 | 87.81 | 88.01 | 88.22 | 88.42 | 88.63 | 88.83 | 89.04 | 89.24 | 89.45 |
| — | 0.49 | 0.49 | 0.50 | 0.50 | 0.51 | 0.51 | 0.51 | 0.52 | 0.52 | 0.51 | 0.51 | 0.51 |
| #37 | 89.65 | 89.86 | 90.06 | 90.27 | 90.47 | 90.67 | 90.88 | 91.08 | 91.29 | 91.49 | 91.69 | 91.90 |
| — | 0.51 | 0.50 | 0.49 | 0.49 | 0.48 | 0.47 | 0.47 | 0.46 | 0.45 | 0.45 | 0.44 | 0.44 |
| #38 | 92.10 | 92.30 | 92.51 | 92.71 | 92.91 | 93.12 | 93.32 | 93.53 | 93.73 | 93.93 | 94.14 | 94.35 |
| — | 0.43 | 0.43 | 0.43 | 0.44 | 0.44 | 0.45 | 0.46 | 0.47 | 0.49 | 0.51 | 0.53 | 0.56 |
| #39 | 94.55 | 94.76 | 94.96 | 95.17 | 95.38 | 95.59 | 95.80 | 96.01 | 96.23 | 96.44 | 96.66 | 96.88 |
| — | 0.59 | 0.63 | 0.68 | 0.73 | 0.79 | 0.86 | 0.93 | 1.02 | 1.11 | 1.22 | 1.34 | 1.47 |
| #40 | 97.09 | 97.32 | 97.54 | 97.76 | 97.99 | 98.21 | 98.44 | 98.67 | 98.91 | 99.14 | 99.37 | 99.61 |
| — | 1.61 | 1.76 | 1.92 | 2.09 | 2.27 | 2.45 | 2.63 | 2.81 | 2.99 | 3.15 | 3.30 | 3.42 |
| #41 | 99.84 | 100.08 | 100.32 | 100.55 | 100.79 | 101.02 | 101.26 | 101.49 | 101.72 | 101.95 | 102.18 | 102.41 |
| — | 3.51 | 3.57 | 3.60 | 3.58 | 3.53 | 3.44 | 3.32 | 3.16 | 2.98 | 2.78 | 2.56 | 2.34 |
| #42 | 102.63 | 102.85 | 103.07 | 103.29 | 103.51 | 103.72 | 103.93 | 104.14 | 104.35 | 104.55 | 104.76 | 104.96 |
| — | 2.12 | 1.90 | 1.69 | 1.49 | 1.30 | 1.13 | 0.97 | 0.83 | 0.70 | 0.59 | 0.49 | 0.41 |
| #43 | 105.16 | 105.36 | 105.56 | 105.76 | 105.96 | 106.16 | 106.36 | 106.56 | 106.75 | 106.95 | 107.15 | 107.34 |
| — | 0.34 | 0.28 | 0.23 | 0.19 | 0.15 | 0.13 | 0.10 | 0.09 | 0.07 | 0.06 | 0.05 | 0.05 |
| #44 | 107.54 | 107.73 | 107.93 | 108.13 | 108.32 | 108.52 | 108.71 | 108.91 | 109.10 | 109.30 | 109.50 | 109.69 |
| — | 0.04 | 0.04 | 0.04 | 0.03 | 0.03 | 0.04 | 0.04 | 0.04 | 0.04 | 0.05 | 0.06 | 0.07 |
| #45 | 109.89 | 110.09 | 110.29 | 110.48 | 110.68 | 110.88 | 111.08 | 111.29 | 111.49 | 111.69 | 111.90 | 112.10 |
| — | 0.08 | 0.09 | 0.11 | 0.14 | 0.17 | 0.21 | 0.25 | 0.30 | 0.37 | 0.44 | 0.53 | 0.63 |
| #46 | 112.31 | 112.52 | 112.73 | 112.95 | 113.16 | 113.38 | 113.60 | 113.82 | 114.05 | 114.27 | 114.50 | 114.73 |
| — | 0.74 | 0.87 | 1.01 | 1.16 | 1.32 | 1.50 | 1.68 | 1.87 | 2.07 | 2.26 | 2.45 | 2.62 |
| #47 | 114.96 | 115.19 | 115.42 | 115.65 | 115.89 | 116.12 | 116.35 | 116.59 | 116.82 | 117.05 | 117.28 | 117.51 |
| — | 2.78 | 2.92 | 3.03 | 3.12 | 3.17 | 3.19 | 3.18 | 3.14 | 3.07 | 2.98 | 2.87 | 2.74 |
| #48 | 117.74 | 117.97 | 118.19 | 118.42 | 118.64 | 118.86 | 119.09 | 119.30 | 119.52 | 119.74 | 119.95 | 120.17 |
| — | 2.60 | 2.45 | 2.30 | 2.15 | 2.00 | 1.86 | 1.72 | 1.59 | 1.47 | 1.36 | 1.25 | 1.16 |
| #49 | 120.38 | 120.59 | 120.80 | 121.01 | 121.22 | 121.43 | 121.64 | 121.84 | 122.05 | 122.26 | 122.46 | 122.67 |
| — | 1.07 | 1.00 | 0.93 | 0.87 | 0.81 | 0.77 | 0.73 | 0.69 | 0.66 | 0.63 | 0.61 | 0.59 |
| #50 | 122.88 | 123.08 | 123.29 | 123.49 | 123.70 | 123.90 | 124.11 | 124.31 | 124.52 | 124.72 | 124.93 | 125.14 |
| — | 0.58 | 0.57 | 0.56 | 0.56 | 0.55 | 0.55 | 0.55 | 0.55 | 0.55 | 0.56 | 0.56 | 0.56 |
| #51 | 125.34 | 125.55 | 125.75 | 125.96 | 126.16 | 126.37 | 126.57 | 126.78 | 126.99 | 127.19 | 127.40 | 127.60 |
| — | 0.57 | 0.57 | 0.57 | 0.57 | 0.57 | 0.57 | 0.57 | 0.56 | 0.56 | 0.55 | 0.54 | 0.53 |
| #52 | 127.81 | 128.01 | 128.22 | 128.42 | 128.62 | 128.83 | 129.03 | 129.23 | 129.44 | 129.64 | 129.84 | 130.05 |
| — | 0.52 | 0.51 | 0.50 | 0.49 | 0.47 | 0.46 | 0.44 | 0.43 | 0.42 | 0.41 | 0.40 | 0.38 |
| #53 | 130.25 | 130.45 | 130.65 | 130.86 | 131.06 | 131.26 | 131.46 | 131.66 | 131.87 | 132.07 | 132.27 | 132.47 |
| — | 0.38 | 0.37 | 0.36 | 0.35 | 0.35 | 0.35 | 0.34 | 0.34 | 0.35 | 0.35 | 0.35 | 0.36 |
| #54 | 132.68 | 132.88 | 133.08 | 133.28 | 133.49 | 133.69 | 133.90 | 134.10 | 134.30 | 134.51 | 134.71 | 134.92 |
| — | 0.37 | 0.38 | 0.39 | 0.40 | 0.42 | 0.43 | 0.45 | 0.47 | 0.50 | 0.52 | 0.54 | 0.57 |
| #55 | 135.13 | 135.33 | 135.54 | 135.75 | 135.95 | 136.16 | 136.37 | 136.58 | 136.79 | 137.00 | 137.21 | 137.42 |
| — | 0.60 | 0.62 | 0.65 | 0.68 | 0.71 | 0.74 | 0.76 | 0.79 | 0.82 | 0.84 | 0.86 | 0.88 |
| #56 | 137.63 | 137.84 | 138.05 | 138.26 | 138.47 | 138.68 | 138.89 | 139.10 | 139.31 | 139.53 | 139.74 | 139.95 |
| — | 0.90 | 0.91 | 0.93 | 0.94 | 0.94 | 0.95 | 0.95 | 0.95 | 0.95 | 0.95 | 0.94 | 0.94 |
| #57 | 140.16 | 140.37 | 140.58 | 140.79 | 141.00 | 141.21 | 141.42 | 141.63 | 141.84 | 142.05 | 142.26 | 142.47 |
| — | 0.93 | 0.93 | 0.92 | 0.91 | 0.90 | 0.90 | 0.89 | 0.88 | 0.88 | 0.87 | 0.87 | 0.87 |
| #58 | 142.68 | 142.89 | 143.10 | 143.31 | 143.52 | 143.73 | 143.94 | 144.15 | 144.36 | 144.57 | 144.78 | 144.99 |
| — | 0.87 | 0.87 | 0.87 | 0.87 | 0.88 | 0.88 | 0.89 | 0.89 | 0.90 | 0.91 | 0.91 | 0.92 |
| #59 | 145.20 | 145.42 | 145.63 | 145.84 | 146.05 | 146.26 | 146.47 | 146.68 | 146.89 | 147.10 | 147.32 | 147.53 |
| — | 0.93 | 0.94 | 0.95 | 0.95 | 0.96 | 0.96 | 0.97 | 0.97 | 0.97 | 0.97 | 0.96 | 0.96 |
| #60 | 147.74 | 147.95 | 148.16 | 148.37 | 148.58 | 148.79 | 149.00 | 149.21 | 149.42 | 149.63 | 149.84 | 150.05 |
| — | 0.95 | 0.94 | 0.93 | 0.92 | 0.91 | 0.89 | 0.87 | 0.86 | 0.84 | 0.82 | 0.80 | 0.78 |

TABLE 3

Distances between conductors (3/3)

| | | | | | | | | | | | | |
|---|---|---|---|---|---|---|---|---|---|---|---|---|
| #61 | 150.26 | 150.46 | 150.67 | 150.88 | 151.09 | 151.29 | 151.50 | 151.71 | 151.91 | 152.12 | 152.32 | 152.53 |
| — | 0.76 | 0.74 | 0.72 | 0.70 | 0.68 | 0.66 | 0.65 | 0.63 | 0.61 | 0.60 | 0.59 | 0.58 |
| #62 | 152.74 | 152.94 | 153.15 | 153.35 | 153.56 | 153.76 | 153.97 | 154.17 | 154.38 | 154.58 | 154.79 | 154.99 |
| — | 0.57 | 0.56 | 0.55 | 0.55 | 0.54 | 0.54 | 0.53 | 0.53 | 0.53 | 0.53 | 0.53 | 0.54 |
| #63 | 155.20 | 155.40 | 155.61 | 155.81 | 156.02 | 156.22 | 156.43 | 156.64 | 156.84 | 157.05 | 157.25 | 157.46 |
| — | 0.54 | 0.54 | 0.55 | 0.55 | 0.56 | 0.56 | 0.57 | 0.57 | 0.58 | 0.58 | 0.59 | 0.59 |
| #64 | 157.66 | 157.87 | 158.08 | 158.28 | 158.49 | 158.70 | 158.90 | 159.11 | 159.31 | 150.52 | 159.73 | 159.93 |
| — | 0.60 | 0.60 | 0.60 | 0.61 | 0.61 | 0.61 | 0.61 | 0.61 | 0.61 | 0.61 | 0.61 | 0.61 |
| #65 | 160.14 | 160.35 | 160.55 | 160.76 | 160.96 | 161.17 | 161.38 | 161.58 | 161.79 | 161.99 | 162.20 | 162.41 |
| — | 0.61 | 0.61 | 0.60 | 0.60 | 0.60 | 0.60 | 0.60 | 0.60 | 0.60 | 0.60 | 0.60 | 0.60 |
| #66 | 162.61 | 162.82 | 163.02 | 163.23 | 163.44 | 163.64 | 163.85 | 164.06 | 164.26 | 164.47 | 164.68 | 164.88 |
| — | 0.60 | 0.60 | 0.60 | 0.61 | 0.61 | 0.62 | 0.63 | 0.63 | 0.64 | 0.65 | 0.66 | 0.67 |
| #67 | 165.09 | 165.30 | 165.51 | 165.71 | 165.92 | 166.13 | 166.34 | 166.55 | 166.75 | 166.96 | 167.17 | 167.38 |
| — | 0.68 | 0.69 | 0.70 | 0.72 | 0.73 | 0.74 | 0.75 | 0.77 | 0.78 | 0.79 | 0.80 | 0.81 |
| #68 | 167.59 | 167.80 | 168.01 | 168.22 | 168.43 | 168.64 | 168.85 | 169.06 | 169.27 | 169.48 | 169.69 | 169.90 |
| — | 0.82 | 0.83 | 0.84 | 0.85 | 0.85 | 0.86 | 0.86 | 0.87 | 0.87 | 0.87 | 0.87 | 0.87 |
| #69 | 170.11 | 170.32 | 170.53 | 170.74 | 170.95 | 171.16 | 171.37 | 171.58 | 171.78 | 171.99 | 172.20 | 172.41 |
| — | 0.86 | 0.86 | 0.86 | 0.85 | 0.85 | 0.84 | 0.83 | 0.83 | 0.82 | 0.81 | 0.81 | 0.80 |
| #70 | 172.62 | 172.83 | 173.04 | 173.25 | 173.46 | 173.66 | 173.87 | 174.08 | 174.29 | 174.50 | 174.71 | 174.91 |
| — | 0.79 | 0.79 | 0.78 | 0.78 | 0.77 | 0.77 | 0.76 | 0.76 | 0.76 | 0.75 | 0.75 | 0.75 |
| #71 | 175.12 | 175.33 | 175.54 | 175.75 | 175.95 | 176.16 | 176.37 | 176.58 | 176.79 | 177.00 | 177.20 | 177.41 |
| — | 0.75 | 0.75 | 0.75 | 0.75 | 0.75 | 0.75 | 0.75 | 0.75 | 0.75 | 0.75 | 0.75 | 0.75 |
| #72 | 177.62 | 177.83 | 178.04 | 178.25 | 178.45 | 178.66 | 178.87 | 179.08 | 179.29 | 179.49 | 179.70 | 179.91 |
| — | 0.75 | 0.75 | 0.75 | 0.75 | 0.74 | 0.74 | 0.74 | 0.73 | 0.73 | 0.72 | 0.72 | 0.71 |
| #73 | 180.12 | 180.32 | 180.53 | 180.74 | 180.95 | 181.15 | 181.36 | 181.57 | 181.77 | 181.98 | 182.19 | 182.39 |
| — | 0.71 | 0.70 | 0.69 | 0.69 | 0.68 | 0.67 | 0.66 | 0.66 | 0.65 | 0.64 | 0.64 | 0.63 |
| #74 | 182.60 | 182.81 | 183.01 | 183.22 | 183.43 | 183.63 | 183.84 | 184.04 | 184.25 | 184.46 | 184.66 | 184.87 |
| — | 0.62 | 0.62 | 0.61 | 0.61 | 0.60 | 0.60 | 0.60 | 0.60 | 0.59 | 0.59 | 0.59 | 0.59 |
| #75 | 185.07 | 185.28 | 185.49 | 185.69 | 185.90 | 186.10 | 186.31 | 186.52 | 186.72 | 186.93 | 187.14 | 187.34 |
| — | 0.59 | 0.60 | 0.60 | 0.60 | 0.60 | 0.61 | 0.61 | 0.62 | 0.62 | 0.62 | 0.63 | 0.64 |
| #76 | 187.55 | 187.76 | 187.96 | 188.17 | 188.38 | 188.58 | 188.79 | 189.00 | 189.20 | 189.41 | 189.62 | 189.83 |
| — | 0.64 | 0.65 | 0.65 | 0.66 | 0.66 | 0.67 | 0.67 | 0.67 | 0.68 | 0.68 | 0.68 | 0.69 |
| #77 | 190.03 | 190.24 | 190.45 | 190.66 | 190.86 | 191.07 | 191.28 | 191.49 | 191.69 | 191.90 | 192.11 | 192.32 |
| — | 0.69 | 0.69 | 0.69 | 0.69 | 0.70 | 0.70 | 0.70 | 0.70 | 0.70 | 0.70 | 0.70 | 0.70 |
| #78 | 192.52 | 192.73 | 192.94 | 193.15 | 193.35 | 193.56 | 193.77 | 193.98 | 194.18 | 194.30 | 194.60 | 194.81 |
| — | 0.70 | 0.70 | 0.70 | 0.70 | 0.70 | 0.70 | 0.70 | 0.70 | 0.70 | 0.70 | 0.71 | 0.71 |
| #79 | 195.01 | 195.22 | 195.43 | 195.64 | 195.85 | 196.05 | 196.26 | 196.47 | 196.68 | 196.89 | 197.09 | 197.30 |
| — | 0.71 | 0.72 | 0.72 | 0.72 | 0.73 | 0.73 | 0.74 | 0.74 | 0.75 | 0.75 | 0.76 | 0.76 |
| #80 | 197.51 | 197.72 | 197.93 | 198.14 | 198.35 | 198.55 | 198.76 | 198.97 | 199.18 | 199.39 | 199.60 | 199.81 |
| — | 0.76 | 0.77 | 0.77 | 0.78 | 0.78 | 0.78 | 0.79 | 0.79 | 0.79 | 0.79 | 0.79 | 0.79 |
| #81 | 200.02 | 200.23 | 200.43 | 200.64 | 200.85 | 201.06 | 201.27 | 201.48 | 201.69 | 201.90 | 202.10 | 202.31 |
| — | 0.79 | 0.79 | 0.79 | 0.79 | 0.79 | 0.78 | 0.78 | 0.78 | 0.77 | 0.77 | 0.76 | 0.76 |
| #82 | 202.52 | 202.73 | 202.94 | 203.14 | 203.35 | 203.56 | 203.77 | 203.98 | 204.18 | 204.39 | 204.60 | 204.81 |
| — | 0.75 | 0.75 | 0.74 | 0.74 | 0.73 | 0.73 | 0.72 | 0.72 | 0.71 | 0.71 | 0.71 | 0.70 |
| #83 | 205.01 | 205.22 | 205.43 | 205.64 | 205.84 | 206.05 | 206.26 | 206.47 | 206.67 | 206.88 | 207.09 | 207.30 |
| — | 0.70 | 0.70 | 0.69 | 0.69 | 0.69 | 0.69 | 0.69 | 0.69 | 0.69 | 0.69 | 0.69 | 0.69 |
| #84 | 207.50 | 207.71 | 207.92 | 208.12 | 208.33 | | | | | | | |
| — | 0.69 | 0.69 | 0.69 | 0.69 | 0.69 | | | | | | | |

Figure 6:
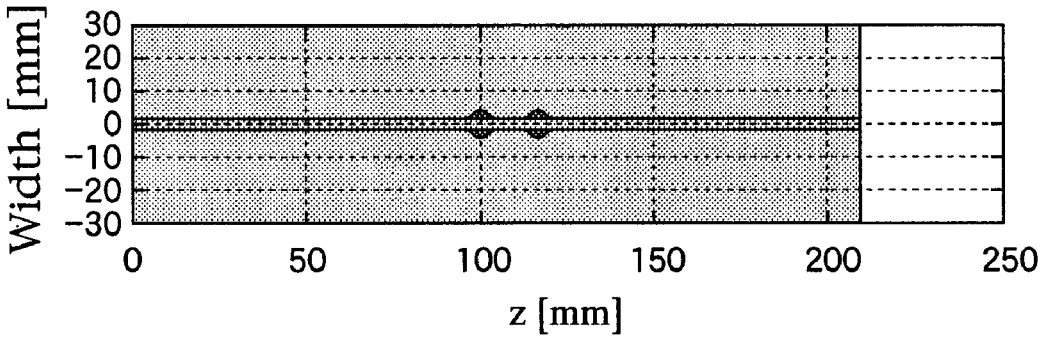
FIG. 6 is a graph showing the shape of the coplanar strip in the reflection-type bandpass filter fabricated in Embodiment 1.

FIG. 6 shows the shape of the coplanar strip in the reflection-type bandpass filter 1 of Embodiment 1. In the figure, the lightly shaded portion represents the center conductor 3 and the side conductors 5*a* and 5*b*, and the heavily shaded lines represent the non-conducting portions 4*a* and 4*b*. A non-reflecting terminator, or an R=75Ω resistance, is provided on the terminating side (the face at z=208.33 mm) of this reflection-type bandpass filter 1. The non-reflecting terminator or resistance may be connected directly to the terminating end of the reflection-type bandpass filter 1. The thicknesses of the metal films of the center conductor 3 and of the side conductors 5*a*, 5*b* are to be thick compared with the skin depth at f=1 GHz, $\delta s=\sqrt{\{2/(\omega\mu_0\sigma)\}}$. Here ω, $\mu_0$, and σ are respectively the angular frequency, permittivity in a vacuum, and the conductivity of the metal. For example, when using copper, the thickness of the center conductor 3 and of the side conductors 5*a*, 5*b* may be 2.1 μm or greater. This bandpass filter 1 is used in a system with a characteristic impedance of 75Ω.

Figure 7:
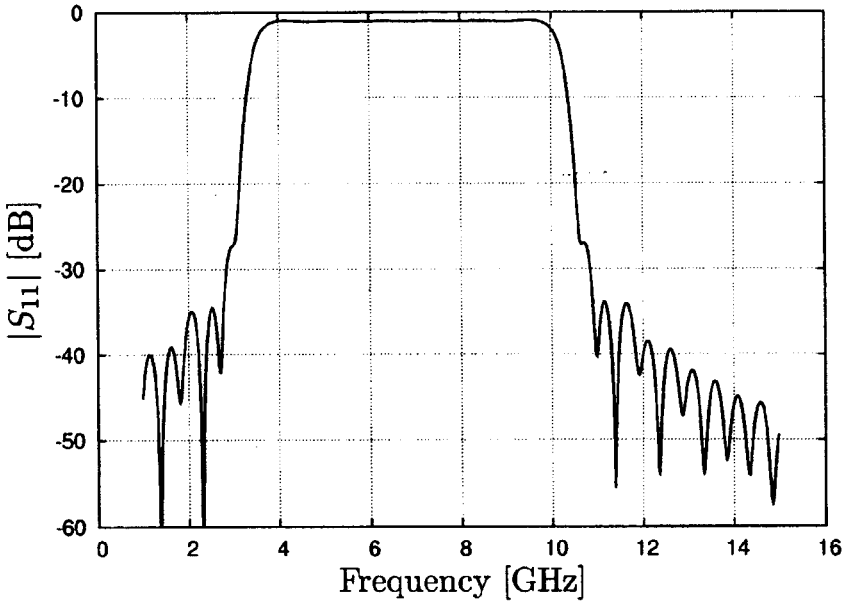
FIG. 7 is a graph showing the reflected wave amplitude characteristic in the reflection-type bandpass filter fabricated in Embodiment 1.
Figure 8:
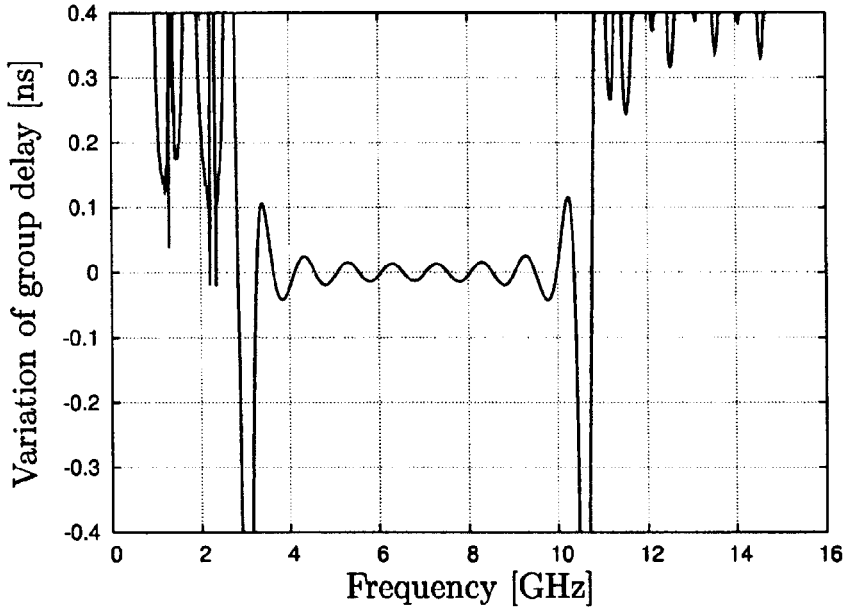
FIG. 8 is a graph showing the reflected wave group delay characteristic in the reflection-type bandpass filter fabricated in Embodiment 1.

FIG. 7 and FIG. 8 show the amplitude characteristic and group delay characteristic respectively of reflected waves ($S_{11}$) in the bandpass filter 1 of Embodiment 1. As shown in the figures, in the range of frequencies f for which 3.9 GHz≦f≦9.8 GHz, the reflectance is −2 dB or greater, and the group delay variation is within ±0.1 ns. In the region f<3.1 GHz or f>10.6 GHz, the reflectance is −15 dB or lower.

Embodiment 2

Figure 9:
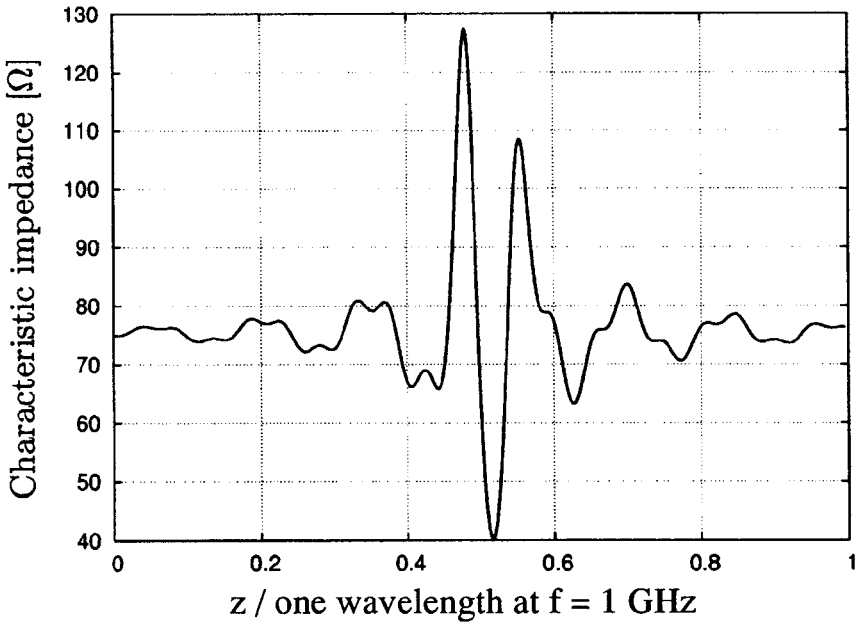
FIG. 9 is a graph showing the characteristic impedance distribution of the reflection-type bandpass filter fabricated in Embodiment 2.

A Kaiser window was used for which the reflectance is 0.8 at frequencies f in the range 3.4 GHz≦f≦10.3 GHz, and is 0 elsewhere, and for which A=30. Design was performed using one wavelength of signals at a frequency f=1 GHz propagating in the coplanar strip as the waveguide length, and setting the system characteristic impedance to 75Ω. FIG. 9 shows the distribution in the z-axis direction of the local characteristic impedance obtained in the inverse problem.

Figure 10:
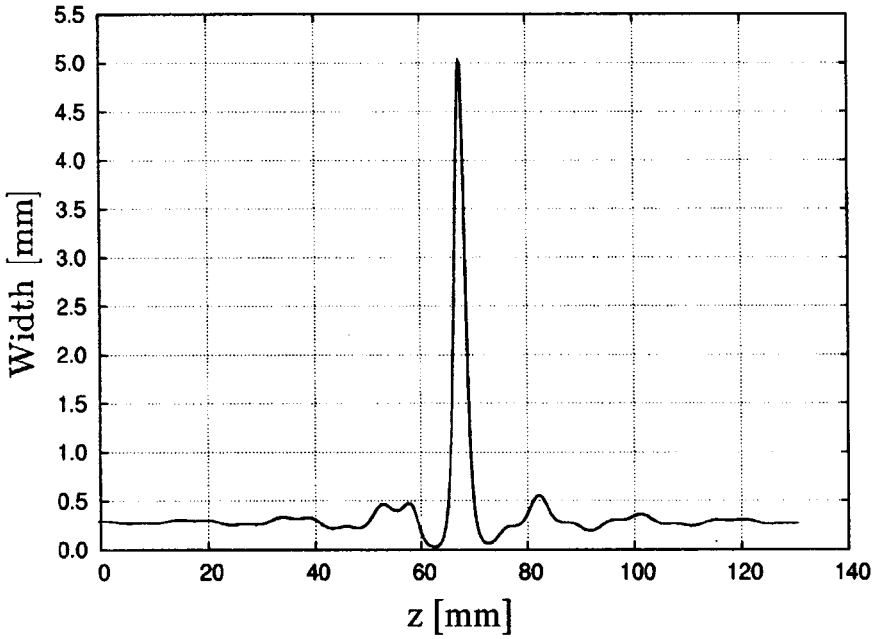
FIG. 10 is a graph showing the distribution of the center conductor width of the coplanar strip in the reflection-type bandpass filter fabricated in Embodiment 2.

FIG. 10 shows the distribution in the z-axis direction of the center conductor width w, when using a substrate 2 with a thickness h=1 mm and relative permittivity $\in_r$=10, and when the distance between conductors s=0.5 mm. Tables 4 through 6 list the center conductor widths w.

TABLE 4

Center conductor widths (1/3)

| | z[mm] | | | | | | | | | | | |
|---|---|---|---|---|---|---|---|---|---|---|---|---|
| | 0.00 | 0.13 | 0.26 | 0.39 | 0.52 | 0.65 | 0.78 | 0.92 | 1.05 | 1.18 | 1.31 | 1.44 |
| | w[mm] | | | | | | | | | | | |
| | 0.29 | 0.29 | 0.29 | 0.29 | 0.29 | 0.29 | 0.29 | 0.29 | 0.29 | 0.29 | 0.29 | 0.29 |
| #2 | 1.57 | 1.70 | 1.83 | 1.96 | 2.09 | 2.22 | 2.35 | 2.48 | 2.62 | 2.75 | 2.88 | 3.01 |
| — | 0.29 | 0.29 | 0.29 | 0.29 | 0.29 | 0.29 | 0.29 | 0.29 | 0.29 | 0.28 | 0.28 | 0.28 |
| #3 | 3.14 | 3.27 | 3.40 | 3.53 | 3.66 | 3.79 | 3.92 | 4.05 | 4.18 | 4.31 | 4.45 | 4.58 |
| — | 0.28 | 0.28 | 0.28 | 0.28 | 0.28 | 0.28 | 0.28 | 0.27 | 0.27 | 0.27 | 0.27 | 0.27 |
| #4 | 4.71 | 4.84 | 4.97 | 5.10 | 5.23 | 5.36 | 5.49 | 5.62 | 5.75 | 5.88 | 6.01 | 6.14 |
| — | 0.27 | 0.27 | 0.27 | 0.27 | 0.27 | 0.27 | 0.27 | 0.27 | 0.27 | 0.27 | 0.27 | 0.27 |
| #5 | 6.27 | 6.41 | 6.54 | 6.67 | 6.80 | 6.93 | 7.06 | 7.19 | 7.32 | 7.45 | 7.58 | 7.71 |
| — | 0.27 | 0.27 | 0.27 | 0.27 | 0.27 | 0.27 | 0.27 | 0.27 | 0.27 | 0.27 | 0.27 | 0.27 |
| #6 | 7.84 | 7.97 | 8.10 | 8.23 | 8.37 | 8.50 | 8.63 | 8.76 | 8.89 | 9.02 | 9.15 | 9.28 |
| — | 0.27 | 0.27 | 0.27 | 0.27 | 0.27 | 0.27 | 0.27 | 0.27 | 0.27 | 0.27 | 0.27 | 0.27 |
| #7 | 9.41 | 9.54 | 9.67 | 9.80 | 9.93 | 10.06 | 10.20 | 10.33 | 10.46 | 10.59 | 10.72 | 10.85 |
| — | 0.27 | 0.27 | 0.27 | 0.27 | 0.27 | 0.27 | 0.27 | 0.27 | 0.27 | 0.27 | 0.27 | 0.27 |
| #8 | 10.98 | 11.11 | 11.24 | 11.37 | 11.50 | 11.63 | 11.76 | 11.89 | 12.02 | 12.16 | 12.29 | 12.42 |
| — | 0.27 | 0.27 | 0.27 | 0.27 | 0.27 | 0.27 | 0.28 | 0.28 | 0.28 | 0.28 | 0.28 | 0.28 |
| #9 | 12.55 | 12.68 | 12.81 | 12.94 | 13.07 | 13.20 | 13.33 | 13.46 | 13.59 | 13.72 | 13.86 | 13.99 |
| — | 0.28 | 0.28 | 0.29 | 0.29 | 0.29 | 0.29 | 0.29 | 0.29 | 0.30 | 0.30 | 0.30 | 0.30 |
| #10 | 14.12 | 14.25 | 14.38 | 14.51 | 14.64 | 14.77 | 14.90 | 15.03 | 15.16 | 15.30 | 15.43 | 15.56 |
| — | 0.30 | 0.30 | 0.30 | 0.30 | 0.30 | 0.31 | 0.31 | 0.31 | 0.31 | 0.31 | 0.31 | 0.31 |
| #11 | 15.69 | 15.82 | 15.95 | 16.08 | 16.21 | 16.34 | 16.47 | 16.60 | 16.73 | 16.87 | 17.00 | 17.13 |
| — | 0.31 | 0.31 | 0.31 | 0.30 | 0.30 | 0.30 | 0.30 | 0.30 | 0.30 | 0.30 | 0.30 | 0.30 |
| #12 | 17.26 | 17.39 | 17.52 | 17.65 | 17.78 | 17.91 | 18.04 | 18.17 | 18.30 | 18.44 | 18.57 | 18.70 |
| — | 0.30 | 0.30 | 0.30 | 0.30 | 0.30 | 0.30 | 0.30 | 0.30 | 0.30 | 0.30 | 0.30 | 0.30 |
| #13 | 18.83 | 18.96 | 19.09 | 19.22 | 19.35 | 19.48 | 19.61 | 19.74 | 19.88 | 20.01 | 20.14 | 20.27 |
| — | 0.30 | 0.30 | 0.30 | 0.30 | 0.30 | 0.30 | 0.30 | 0.30 | 0.30 | 0.30 | 0.30 | 0.30 |
| #14 | 20.40 | 20.53 | 20.66 | 20.79 | 20.92 | 21.05 | 21.18 | 21.31 | 21.45 | 21.58 | 21.71 | 21.84 |
| — | 0.30 | 0.30 | 0.30 | 0.30 | 0.30 | 0.30 | 0.30 | 0.29 | 0.29 | 0.29 | 0.29 | 0.29 |
| #15 | 21.97 | 22.10 | 22.23 | 22.36 | 22.49 | 22.62 | 22.75 | 22.88 | 23.01 | 23.14 | 23.28 | 23.41 |
| — | 0.29 | 0.28 | 0.28 | 0.28 | 0.28 | 0.27 | 0.27 | 0.27 | 0.27 | 0.27 | 0.26 | 0.26 |
| #16 | 23.54 | 23.67 | 23.80 | 23.93 | 24.06 | 24.19 | 24.32 | 24.45 | 24.58 | 24.71 | 24.84 | 24.97 |
| — | 0.26 | 0.26 | 0.26 | 0.26 | 0.25 | 0.25 | 0.25 | 0.25 | 0.25 | 0.25 | 0.25 | 0.25 |
| #17 | 25.10 | 25.23 | 25.36 | 25.49 | 25.63 | 25.76 | 25.89 | 26.02 | 26.15 | 26.28 | 26.41 | 26.54 |
| — | 0.25 | 0.25 | 0.25 | 0.25 | 0.25 | 0.25 | 0.26 | 0.26 | 0.26 | 0.26 | 0.26 | 0.26 |
| #18 | 26.67 | 26.80 | 26.93 | 27.06 | 27.19 | 27.32 | 27.45 | 27.58 | 27.71 | 27.85 | 27.98 | 28.11 |
| — | 0.26 | 0.26 | 0.26 | 0.26 | 0.26 | 0.26 | 0.26 | 0.26 | 0.26 | 0.26 | 0.26 | 0.26 |
| #19 | 28.24 | 28.37 | 28.50 | 28.63 | 28.76 | 28.89 | 29.02 | 29.15 | 29.28 | 29.41 | 29.54 | 29.67 |
| — | 0.26 | 0.26 | 0.26 | 0.26 | 0.26 | 0.26 | 0.26 | 0.26 | 0.26 | 0.26 | 0.26 | 0.26 |
| #20 | 29.80 | 29.93 | 30.07 | 30.20 | 30.33 | 30.46 | 30.59 | 30.72 | 30.85 | 30.98 | 31.11 | 31.24 |
| — | 0.26 | 0.26 | 0.26 | 0.26 | 0.26 | 0.26 | 0.26 | 0.26 | 0.27 | 0.27 | 0.27 | 0.27 |
| #21 | 31.37 | 31.50 | 31.63 | 31.76 | 31.89 | 32.03 | 32.16 | 32.29 | 32.42 | 32.55 | 32.68 | 32.81 |
| — | 0.28 | 0.28 | 0.28 | 0.29 | 0.29 | 0.29 | 0.30 | 0.39 | 0.30 | 0.31 | 0.31 | 0.31 |
| #22 | 32.94 | 33.07 | 33.20 | 33.33 | 33.47 | 33.60 | 33.73 | 33.86 | 33.99 | 34.12 | 34.25 | 34.38 |
| — | 0.32 | 0.32 | 0.32 | 0.33 | 0.33 | 0.33 | 0.33 | 0.33 | 0.33 | 0.33 | 0.34 | 0.34 |
| #23 | 34.51 | 34.65 | 34.78 | 34.91 | 35.04 | 35.17 | 35.30 | 35.43 | 35.56 | 35.69 | 35.82 | 35.96 |
| — | 0.34 | 0.33 | 0.33 | 0.33 | 0.33 | 0.33 | 0.33 | 0.33 | 0.33 | 0.33 | 0.32 | 0.32 |
| #24 | 36.09 | 36.22 | 36.35 | 36.48 | 36.61 | 36.74 | 36.87 | 37.00 | 37.13 | 37.27 | 37.40 | 37.53 |
| — | 0.32 | 0.32 | 0.32 | 0.32 | 0.32 | 0.32 | 0.32 | 0.32 | 0.32 | 0.32 | 0.32 | 0.32 |
| #25 | 37.66 | 37.79 | 37.92 | 38.05 | 38.18 | 38.31 | 38.44 | 38.58 | 38.71 | 38.84 | 38.97 | 39.10 |
| — | 0.32 | 0.32 | 0.32 | 0.32 | 0.32 | 0.32 | 0.33 | 0.33 | 0.33 | 0.33 | 0.33 | 0.33 |
| #26 | 39.23 | 39.36 | 39.49 | 39.62 | 39.75 | 39.89 | 40.02 | 40.15 | 40.28 | 40.41 | 40.54 | 40.67 |
| — | 0.33 | 0.33 | 0.33 | 0.33 | 0.33 | 0.32 | 0.32 | 0.32 | 0.32 | 0.31 | 0.31 | 0.30 |
| #27 | 40.80 | 40.93 | 41.06 | 41.19 | 41.33 | 41.46 | 41.59 | 41.72 | 41.85 | 41.98 | 42.11 | 42.24 |
| — | 0.30 | 0.29 | 0.29 | 0.28 | 0.28 | 0.27 | 0.27 | 0.26 | 0.26 | 0.25 | 0.25 | 0.24 |
| #28 | 42.37 | 42.50 | 42.63 | 42.76 | 42.89 | 43.02 | 43.15 | 43.28 | 43.41 | 43.54 | 43.67 | 43.80 |
| — | 0.24 | 0.24 | 0.23 | 0.23 | 0.23 | 0.22 | 0.22 | 0.22 | 0.22 | 0.22 | 0.22 | 0.22 |
| #29 | 43.93 | 44.06 | 44.20 | 44.33 | 44.46 | 44.59 | 44.72 | 44.85 | 44.98 | 45.11 | 45.24 | 45.37 |
| — | 0.22 | 0.22 | 0.22 | 0.22 | 0.22 | 0.22 | 0.22 | 0.22 | 0.22 | 0.23 | 0.23 | 0.23 |
| #30 | 45.50 | 45.63 | 45.76 | 45.89 | 46.02 | 46.15 | 46.28 | 46.41 | 46.54 | 46.67 | 46.80 | 46.93 |
| — | 0.23 | 0.23 | 0.23 | 0.23 | 0.23 | 0.24 | 0.24 | 0.24 | 0.24 | 0.24 | 0.24 | 0.23 |

TABLE 5

Center conductor widths (2/3)

| | | | | | | | | | | | | |
|---|---|---|---|---|---|---|---|---|---|---|---|---|
| #31 | 47.06 | 47.19 | 47.32 | 47.46 | 47.59 | 47.72 | 47.85 | 47.98 | 48.11 | 48.24 | 48.37 | 48.50 |
| — | 0.23 | 0.23 | 0.23 | 0.23 | 0.23 | 0.23 | 0.22 | 0.22 | 0.22 | 0.22 | 0.22 | 0.22 |
| #32 | 48.63 | 48.76 | 48.89 | 49.02 | 49.15 | 49.28 | 49.41 | 49.54 | 49.67 | 49.80 | 49.93 | 50.06 |
| — | 0.22 | 0.22 | 0.22 | 0.22 | 0.22 | 0.22 | 0.23 | 0.23 | 0.23 | 0.24 | 0.24 | 0.25 |

TABLE 5-continued

| Center conductor widths (2/3) | | | | | | | | | | | | |
|---|---|---|---|---|---|---|---|---|---|---|---|---|
| #33 | 50.19 | 50.32 | 50.45 | 50.59 | 50.72 | 50.85 | 50.98 | 51.11 | 51.24 | 51.37 | 51.50 | 51.63 |
| — | 0.25 | 0.26 | 0.27 | 0.28 | 0.29 | 0.30 | 0.31 | 0.32 | 0.33 | 0.34 | 0.35 | 0.36 |
| #34 | 51.76 | 51.90 | 52.03 | 52.16 | 52.29 | 52.42 | 52.55 | 52.69 | 52.82 | 52.95 | 53.08 | 53.21 |
| — | 0.37 | 0.39 | 0.40 | 0.41 | 0.42 | 0.43 | 0.44 | 0.44 | 0.45 | 0.46 | 0.46 | 0.46 |
| #35 | 53.35 | 53.48 | 53.61 | 53.74 | 53.87 | 54.01 | 54.14 | 54.27 | 54.40 | 54.53 | 54.66 | 54.80 |
| — | 0.47 | 0.47 | 0.47 | 0.46 | 0.46 | 0.46 | 0.45 | 0.45 | 0.44 | 0.44 | 0.43 | 0.42 |
| #36 | 54.93 | 55.06 | 55.19 | 55.32 | 55.45 | 55.58 | 55.72 | 55.85 | 55.98 | 56.11 | 56.24 | 56.37 |
| — | 0.42 | 0.41 | 0.41 | 0.41 | 0.40 | 0.40 | 0.40 | 0.40 | 0.40 | 0.40 | 0.40 | 0.40 |
| #37 | 56.51 | 56.64 | 56.77 | 56.90 | 57.03 | 57.16 | 57.30 | 57.43 | 57.56 | 57.69 | 57.82 | 57.95 |
| — | 0.41 | 0.41 | 0.41 | 0.42 | 0.43 | 0.43 | 0.44 | 0.45 | 0.45 | 0.46 | 0.47 | 0.47 |
| #38 | 58.09 | 58.22 | 58.35 | 58.48 | 58.61 | 58.75 | 58.88 | 59.01 | 59.14 | 59.27 | 59.40 | 59.54 |
| — | 0.47 | 0.48 | 0.47 | 0.47 | 0.47 | 0.46 | 0.45 | 0.44 | 0.42 | 0.40 | 0.39 | 0.36 |
| #39 | 59.67 | 59.80 | 59.93 | 60.06 | 60.19 | 60.32 | 60.45 | 60.58 | 60.71 | 60.84 | 60.97 | 61.10 |
| — | 0.34 | 0.32 | 0.30 | 0.27 | 0.25 | 0.23 | 0.20 | 0.18 | 0.16 | 0.15 | 0.13 | 0.12 |
| #40 | 61.23 | 61.36 | 61.49 | 61.62 | 61.75 | 61.88 | 62.01 | 62.14 | 62.26 | 62.39 | 62.52 | 62.65 |
| — | 0.10 | 0.09 | 0.08 | 0.07 | 0.06 | 0.05 | 0.05 | 0.04 | 0.04 | 0.04 | 0.03 | 0.03 |
| #41 | 62.78 | 62.91 | 63.04 | 63.17 | 63.30 | 63.43 | 63.55 | 63.68 | 63.81 | 63.94 | 64.07 | 64.20 |
| — | 0.03 | 0.03 | 0.03 | 0.03 | 0.03 | 0.03 | 0.03 | 0.04 | 0.04 | 0.05 | 0.05 | 0.06 |
| #42 | 64.33 | 64.46 | 64.59 | 64.72 | 64.85 | 64.98 | 65.11 | 65.24 | 65.37 | 65.50 | 65.63 | 65.76 |
| — | 0.07 | 0.08 | 0.10 | 0.11 | 0.14 | 0.16 | 0.20 | 0.24 | 0.28 | 0.34 | 0.41 | 0.50 |
| #43 | 65.90 | 66.03 | 66.17 | 66.30 | 66.44 | 66.58 | 66.72 | 66.86 | 67.01 | 67.15 | 67.30 | 67.45 |
| — | 0.60 | 0.72 | 0.86 | 1.03 | 1.24 | 1.49 | 1.79 | 2.14 | 2.54 | 2.98 | 3.44 | 3.90 |
| #44 | 67.61 | 67.76 | 67.91 | 68.07 | 68.22 | 68.38 | 68.53 | 68.68 | 68.83 | 68.98 | 69.13 | 69.27 |
| — | 4.32 | 4.66 | 4.90 | 5.02 | 5.00 | 4.84 | 4.57 | 4.20 | 3.78 | 3.33 | 2.88 | 2.46 |
| #45 | 69.42 | 69.56 | 69.70 | 69.83 | 69.97 | 70.10 | 70.24 | 70.37 | 70.50 | 70.63 | 70.77 | 70.90 |
| — | 2.08 | 1.76 | 1.48 | 1.24 | 1.05 | 0.88 | 0.75 | 0.63 | 0.54 | 0.46 | 0.39 | 0.33 |
| #46 | 71.03 | 71.16 | 71.29 | 71.42 | 71.55 | 71.68 | 71.81 | 71.94 | 72.07 | 72.20 | 72.33 | 72.46 |
| — | 0.28 | 0.24 | 0.21 | 0.18 | 0.16 | 0.14 | 0.12 | 0.11 | 0.10 | 0.09 | 0.08 | 0.08 |
| #47 | 72.59 | 72.71 | 72.84 | 72.97 | 73.10 | 73.23 | 73.36 | 73.49 | 73.62 | 73.75 | 73.88 | 74.01 |
| — | 0.07 | 0.07 | 0.07 | 0.06 | 0.06 | 0.06 | 0.06 | 0.07 | 0.07 | 0.07 | 0.07 | 0.08 |
| #48 | 74.14 | 74.27 | 74.40 | 74.53 | 74.66 | 74.79 | 74.92 | 75.05 | 75.18 | 75.30 | 75.43 | 75.56 |
| — | 0.08 | 0.09 | 0.10 | 0.10 | 0.11 | 0.12 | 0.13 | 0.13 | 0.14 | 0.15 | 0.16 | 0.17 |
| #49 | 75.70 | 75.83 | 75.96 | 76.09 | 76.22 | 76.35 | 76.48 | 76.61 | 76.74 | 76.87 | 77.00 | 77.13 |
| — | 0.18 | 0.19 | 0.20 | 0.20 | 0.21 | 0.22 | 0.22 | 0.23 | 0.23 | 0.23 | 0.24 | 0.24 |
| #50 | 77.26 | 77.39 | 77.52 | 77.65 | 77.78 | 77.91 | 78.04 | 78.17 | 78.30 | 78.43 | 78.56 | 78.69 |
| — | 0.24 | 0.24 | 0.24 | 0.24 | 0.24 | 0.24 | 0.24 | 0.24 | 0.24 | 0.24 | 0.24 | 0.24 |
| #51 | 78.82 | 78.96 | 79.09 | 79.22 | 79.35 | 79.48 | 79.61 | 79.74 | 79.87 | 80.00 | 80.13 | 80.26 |
| — | 0.25 | 0.25 | 0.25 | 0.26 | 0.26 | 0.27 | 0.28 | 0.29 | 0.29 | 0.30 | 0.32 | 0.33 |
| #52 | 80.39 | 80.53 | 80.66 | 80.79 | 80.92 | 81.05 | 81.18 | 81.31 | 81.45 | 81.58 | 81.71 | 81.84 |
| — | 0.34 | 0.35 | 0.37 | 0.38 | 0.40 | 0.42 | 0.43 | 0.45 | 0.46 | 0.48 | 0.49 | 0.51 |
| #53 | 81.98 | 82.11 | 82.24 | 82.37 | 82.50 | 82.64 | 82.77 | 82.90 | 83.03 | 83.17 | 83.30 | 83.43 |
| — | 0.52 | 0.53 | 0.54 | 0.54 | 0.55 | 0.55 | 0.55 | 0.55 | 0.55 | 0.54 | 0.53 | 0.52 |
| #54 | 83.56 | 83.70 | 83.83 | 83.96 | 84.09 | 84.22 | 84.36 | 84.49 | 84.62 | 84.75 | 84.88 | 85.01 |
| — | 0.51 | 0.50 | 0.49 | 0.47 | 0.46 | 0.44 | 0.43 | 0.42 | 0.40 | 0.39 | 0.38 | 0.36 |
| #55 | 85.14 | 85.28 | 85.41 | 85.54 | 85.67 | 85.80 | 85.93 | 86.06 | 86.19 | 86.32 | 86.45 | 86.58 |
| — | 0.35 | 0.34 | 0.33 | 0.32 | 0.32 | 0.31 | 0.30 | 0.30 | 0.29 | 0.29 | 0.28 | 0.28 |
| #56 | 86.71 | 86.85 | 86.98 | 87.11 | 87.24 | 87.37 | 87.50 | 87.63 | 87.76 | 87.89 | 88.02 | 88.15 |
| — | 0.28 | 0.28 | 0.28 | 0.28 | 0.28 | 0.28 | 0.28 | 0.28 | 0.28 | 0.28 | 0.28 | 0.28 |
| #57 | 88.28 | 88.41 | 88.54 | 88.68 | 88.81 | 88.94 | 89.07 | 89.20 | 89.33 | 89.46 | 89.59 | 89.72 |
| — | 0.28 | 0.28 | 0.27 | 0.27 | 0.27 | 0.27 | 0.27 | 0.27 | 0.26 | 0.26 | 0.26 | 0.25 |
| #58 | 89.85 | 89.98 | 90.11 | 90.24 | 90.37 | 90.50 | 90.63 | 90.76 | 90.89 | 91.02 | 91.15 | 91.28 |
| — | 0.25 | 0.24 | 0.24 | 0.23 | 0.23 | 0.23 | 0.22 | 0.22 | 0.21 | 0.21 | 0.21 | 0.20 |
| #59 | 91.41 | 91.54 | 91.68 | 91.81 | 91.94 | 92.07 | 92.20 | 92.33 | 92.46 | 92.59 | 92.72 | 92.85 |
| — | 0.20 | 0.20 | 0.19 | 0.19 | 0.19 | 0.19 | 0.19 | 0.19 | 0.19 | 0.19 | 0.19 | 0.19 |
| #60 | 92.98 | 93.11 | 93.24 | 93.37 | 93.50 | 93.63 | 93.76 | 93.89 | 94.02 | 94.15 | 94.28 | 94.41 |
| — | 0.20 | 0.20 | 0.20 | 0.21 | 0.21 | 0.21 | 0.22 | 0.22 | 0.23 | 0.23 | 0.24 | 0.24 |

TABLE 6

| Center conductor widths (3/3) | | | | | | | | | | | | |
|---|---|---|---|---|---|---|---|---|---|---|---|---|
| #61 | 94.54 | 94.67 | 94.80 | 94.93 | 95.06 | 95.19 | 95.32 | 95.46 | 95.59 | 95.72 | 95.85 | 95.98 |
| — | 0.25 | 0.25 | 0.26 | 0.26 | 0.27 | 0.27 | 0.28 | 0.28 | 0.29 | 0.29 | 0.29 | 0.30 |
| #62 | 96.11 | 96.24 | 96.37 | 96.50 | 96.63 | 96.76 | 96.90 | 97.03 | 97.16 | 97.29 | 97.42 | 97.55 |
| — | 0.30 | 0.30 | 0.30 | 0.30 | 0.31 | 0.31 | 0.31 | 0.31 | 0.31 | 0.31 | 0.31 | 0.31 |
| #63 | 97.68 | 97.81 | 97.94 | 98.07 | 98.20 | 98.33 | 98.47 | 98.60 | 98.73 | 98.86 | 98.99 | 99.12 |
| — | 0.30 | 0.30 | 0.30 | 0.30 | 0.30 | 0.30 | 0.31 | 0.31 | 0.31 | 0.31 | 0.31 | 0.31 |
| #64 | 99.25 | 99.38 | 99.51 | 99.64 | 99.78 | 99.91 | 100.04 | 100.17 | 100.30 | 100.43 | 100.56 | 100.69 |
| — | 0.31 | 0.32 | 0.32 | 0.32 | 0.32 | 0.33 | 0.33 | 0.33 | 0.34 | 0.34 | 0.34 | 0.35 |
| #65 | 100.82 | 100.96 | 101.09 | 101.22 | 101.35 | 101.48 | 101.61 | 101.74 | 101.87 | 102.01 | 102.14 | 102.27 |
| — | 0.35 | 0.35 | 0.36 | 0.36 | 0.36 | 0.36 | 0.36 | 0.36 | 0.36 | 0.36 | 0.36 | 0.36 |
| #66 | 102.40 | 102.53 | 102.66 | 102.79 | 102.92 | 103.05 | 103.19 | 103.32 | 103.45 | 103.58 | 103.71 | 103.84 |
| — | 0.36 | 0.36 | 0.35 | 0.35 | 0.35 | 0.34 | 0.34 | 0.33 | 0.33 | 0.32 | 0.32 | 0.31 |
| #67 | 103.97 | 104.10 | 104.23 | 104.36 | 104.50 | 104.63 | 104.76 | 104.89 | 105.02 | 105.15 | 105.28 | 105.41 |

TABLE 6-continued

| Center conductor widths (3/3) | | | | | | | | | | | | |
|---|---|---|---|---|---|---|---|---|---|---|---|---|
| — | 0.31 | 0.30 | 0.30 | 0.30 | 0.29 | 0.29 | 0.28 | 0.28 | 0.28 | 0.27 | 0.27 | 0.27 |
| #68 | 105.54 | 105.67 | 105.80 | 105.93 | 106.06 | 106.19 | 106.32 | 106.46 | 106.59 | 106.72 | 106.85 | 106.98 |
| — | 0.27 | 0.27 | 0.26 | 0.26 | 0.26 | 0.26 | 0.26 | 0.26 | 0.26 | 0.26 | 0.26 | 0.26 |
| #69 | 107.11 | 107.24 | 107.37 | 107.50 | 107.63 | 107.76 | 107.89 | 108.02 | 108.15 | 108.28 | 108.41 | 108.54 |
| — | 0.26 | 0.26 | 0.26 | 0.26 | 0.26 | 0.26 | 0.26 | 0.26 | 0.26 | 0.26 | 0.26 | 0.26 |
| #70 | 108.68 | 108.81 | 108.94 | 109.07 | 109.20 | 109.33 | 109.46 | 109.59 | 109.72 | 109.85 | 109.98 | 110.11 |
| — | 0.26 | 0.26 | 0.26 | 0.26 | 0.26 | 0.26 | 0.26 | 0.26 | 0.25 | 0.25 | 0.25 | 0.25 |
| #71 | 110.24 | 110.37 | 110.50 | 110.63 | 110.76 | 110.90 | 111.03 | 111.16 | 111.29 | 111.42 | 111.55 | 111.68 |
| — | 0.25 | 0.25 | 0.25 | 0.25 | 0.24 | 0.24 | 0.24 | 0.24 | 0.24 | 0.24 | 0.24 | 0.24 |
| #72 | 111.81 | 111.94 | 112.07 | 112.20 | 112.33 | 112.46 | 112.59 | 112.72 | 112.85 | 112.98 | 113.11 | 113.24 |
| — | 0.24 | 0.24 | 0.25 | 0.25 | 0.25 | 0.25 | 0.25 | 0.25 | 0.26 | 0.26 | 0.26 | 0.27 |
| #73 | 113.38 | 113.51 | 113.64 | 113.77 | 113.90 | 114.03 | 114.16 | 114.29 | 114.42 | 114.55 | 114.68 | 114.81 |
| — | 0.27 | 0.27 | 0.27 | 0.28 | 0.28 | 0.28 | 0.29 | 0.29 | 0.29 | 0.29 | 0.30 | 0.30 |
| #74 | 114.94 | 115.08 | 115.21 | 115.34 | 115.47 | 115.60 | 115.73 | 115.86 | 115.99 | 116.12 | 116.25 | 116.38 |
| — | 0.30 | 0.30 | 0.30 | 0.30 | 0.31 | 0.31 | 0.31 | 0.31 | 0.31 | 0.31 | 0.31 | 0.31 |
| #75 | 116.52 | 116.65 | 116.78 | 116.91 | 117.04 | 117.17 | 117.30 | 117.43 | 117.56 | 117.69 | 117.82 | 117.95 |
| — | 0.31 | 0.31 | 0.31 | 0.31 | 0.30 | 0.30 | 0.30 | 0.30 | 0.30 | 0.30 | 0.30 | 0.30 |
| #76 | 118.09 | 118.22 | 118.35 | 118.48 | 118.61 | 118.74 | 118.87 | 119.00 | 119.13 | 119.26 | 119.39 | 119.53 |
| — | 0.30 | 0.30 | 0.30 | 0.30 | 0.30 | 0.30 | 0.30 | 0.30 | 0.30 | 0.30 | 0.30 | 0.31 |
| #77 | 119.66 | 119.79 | 119.92 | 120.05 | 120.18 | 120.31 | 120.44 | 120.57 | 120.70 | 120.83 | 120.97 | 121.10 |
| — | 0.31 | 0.31 | 0.31 | 0.31 | 0.31 | 0.31 | 0.31 | 0.31 | 0.31 | 0.31 | 0.31 | 0.31 |
| #78 | 121.23 | 121.36 | 121.49 | 121.62 | 121.75 | 121.88 | 122.01 | 122.14 | 122.27 | 122.41 | 122.54 | 122.67 |
| — | 0.31 | 0.31 | 0.31 | 0.31 | 0.31 | 0.31 | 0.31 | 0.30 | 0.30 | 0.30 | 0.30 | 0.30 |
| #79 | 122.80 | 122.93 | 123.06 | 123.19 | 123.32 | 123.45 | 123.58 | 123.71 | 123.84 | 123.97 | 124.11 | 124.24 |
| — | 0.29 | 0.29 | 0.29 | 0.29 | 0.29 | 0.28 | 0.28 | 0.28 | 0.28 | 0.28 | 0.27 | 0.27 |
| #80 | 124.37 | 124.50 | 124.63 | 124.76 | 124.89 | 125.02 | 125.15 | 125.28 | 125.41 | 125.54 | 125.67 | 125.80 |
| — | 0.27 | 0.27 | 0.27 | 0.27 | 0.27 | 0.27 | 0.26 | 0.26 | 0.26 | 0.26 | 0.26 | 0.26 |
| #81 | 125.93 | 126.06 | 126.20 | 126.33 | 126.46 | 126.59 | 126.72 | 126.85 | 126.98 | 127.11 | 127.24 | 127.37 |
| — | 0.26 | 0.26 | 0.26 | 0.27 | 0.27 | 0.27 | 0.27 | 0.27 | 0.27 | 0.27 | 0.27 | 0.27 |
| #82 | 127.50 | 127.63 | 127.76 | 127.89 | 128.02 | 128.16 | 128.29 | 128.42 | 128.55 | 128.68 | 128.81 | 128.94 |
| — | 0.27 | 0.27 | 0.27 | 0.27 | 0.27 | 0.27 | 0.27 | 0.27 | 0.27 | 0.27 | 0.27 | 0.27 |
| #83 | 129.07 | 129.20 | 129.33 | 129.46 | 129.59 | 129.72 | 129.85 | 129.98 | 130.12 | 130.25 | 130.38 | 130.51 |
| — | 0.27 | 0.27 | 0.27 | 0.27 | 0.27 | 0.27 | 0.27 | 0.27 | 0.27 | 0.27 | 0.27 | 0.27 |
| #84 | 130.64 | 130.77 | 130.90 | 131.03 | 131.16 | | | | | | | |
| — | 0.27 | 0.27 | 0.27 | 0.27 | 0.27 | | | | | | | |

Figure 11:
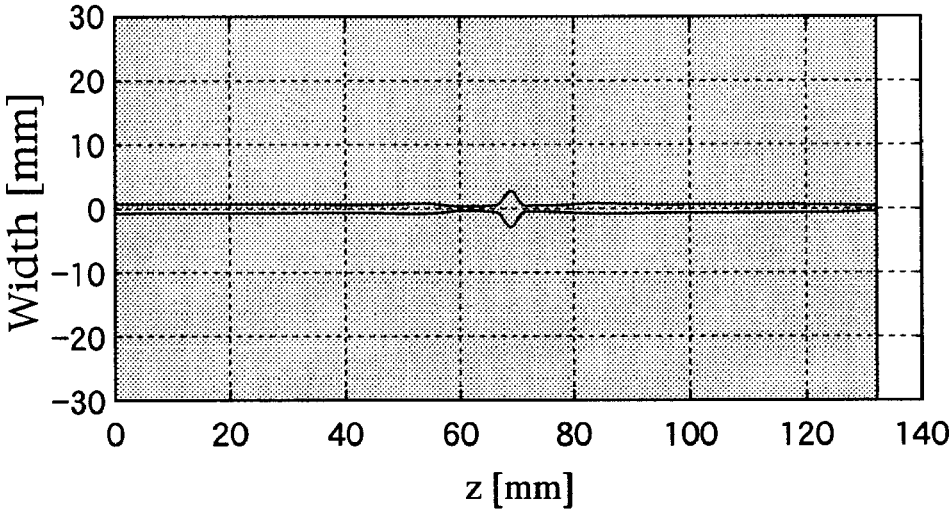
FIG. 11 is a graph showing the shape of the coplanar strip in the reflection-type bandpass filter fabricated in Embodiment 2.

FIG. 11 shows the shape of the coplanar strip in the reflection-type bandpass filter 1 of Embodiment 2. In the figure, the lightly shaded portion represents the center conductor 3 and the side conductors 5*a* and 5*b*, and the heavily shaded lines represent the non-conducting portions 4*a* and 4*b*. A non-reflecting terminator, or an R=75Ω resistance, is provided on the terminating side (the face at z=131.16 mm) of this reflection-type bandpass filter 1. The thicknesses of the metal films of the center conductor 3 and of the side conductors 5*a*, 5*b* are to be thick compared with the skin depth at f=1 GHz. For example, when using copper, the thickness of the center conductor 3 and of the side conductors 5*a*, 5*b* may be 2.1 μm or greater. This bandpass filter 1 is used in a system with a characteristic impedance of 75Ω.

Figure 12:
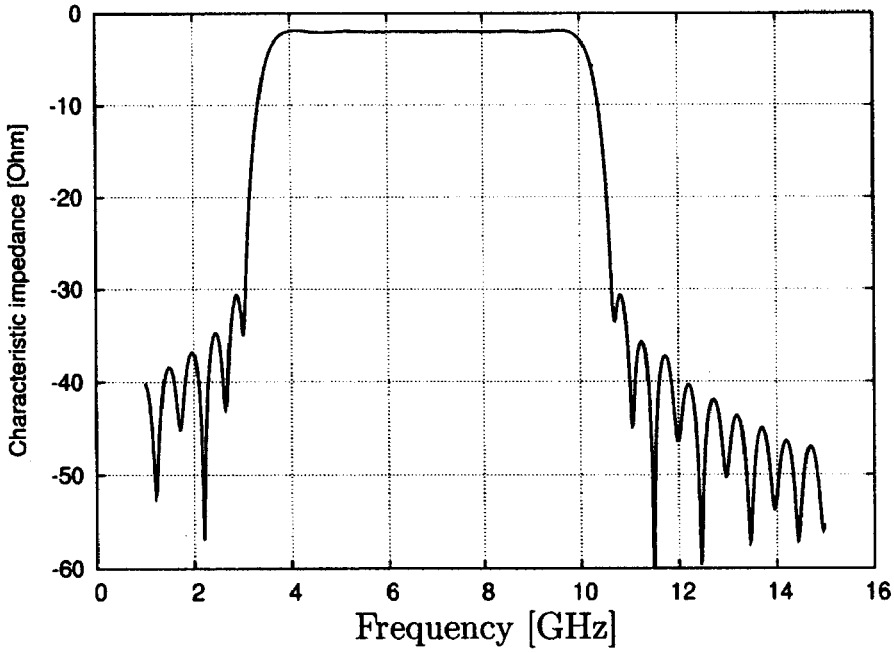
FIG. 12 is a graph showing the reflected wave amplitude characteristic in the reflection-type bandpass filter fabricated in Embodiment 2.
Figure 13:
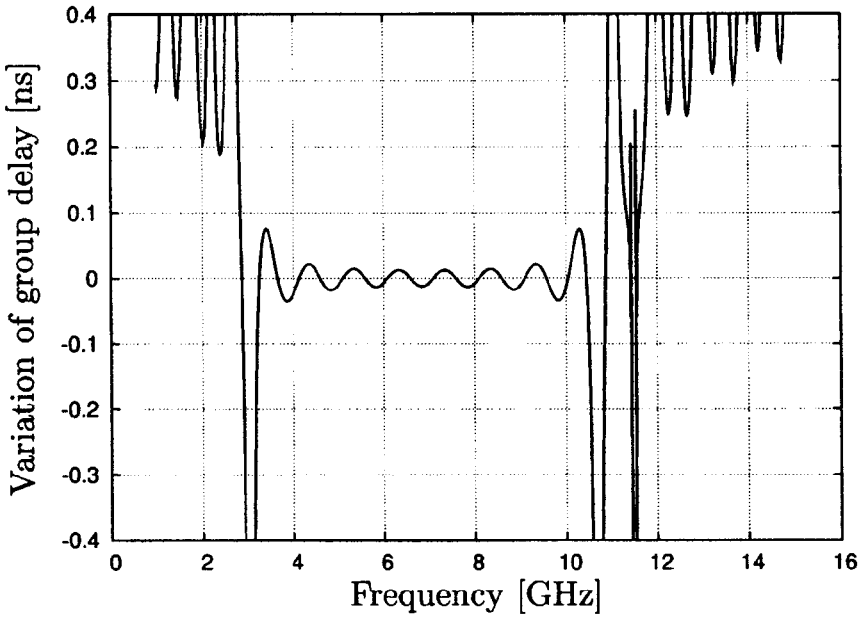
FIG. 13 is a graph showing the reflected wave group delay characteristic in the reflection-type bandpass filter fabricated in Embodiment 2.

FIG. 12 and FIG. 13 show the amplitude characteristic and group delay characteristic respectively of reflected waves ($S_{11}$) in the bandpass filter 1 of Embodiment 2. As shown in the figures, in the range of frequencies f for which 3.7 GHz≦f≦10.0 GHz, the reflectance is −5 dB or greater, and the group delay variation is within ±0.1 ns. In the region f<3.1 GHz or f>10.6 GHz, the reflectance is −20 dB or lower.

Embodiment 3

Figure 14:
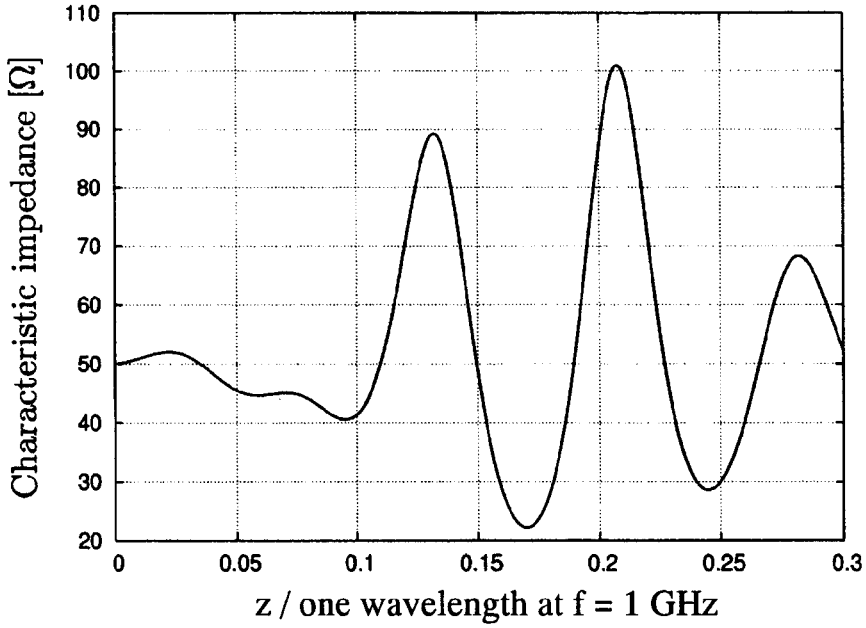
FIG. 14 is a graph showing the characteristic impedance distribution of the reflection-type bandpass filter fabricated in Embodiment 3.

A Kaiser window was used for which the reflectance is 1 at frequencies f in the range 3.7 GHz≦f≦10.0 GHz, and is 0 elsewhere, and for which A=30. Design was performed using 0.3 wavelength of signals at frequency f=1 GHz propagating in the coplanar strip as the waveguide length, and setting the system characteristic impedance to 50Ω. FIG. 14 shows the distribution in the z-axis direction of the local characteristic impedance obtained in the inverse problem.

Figure 15:
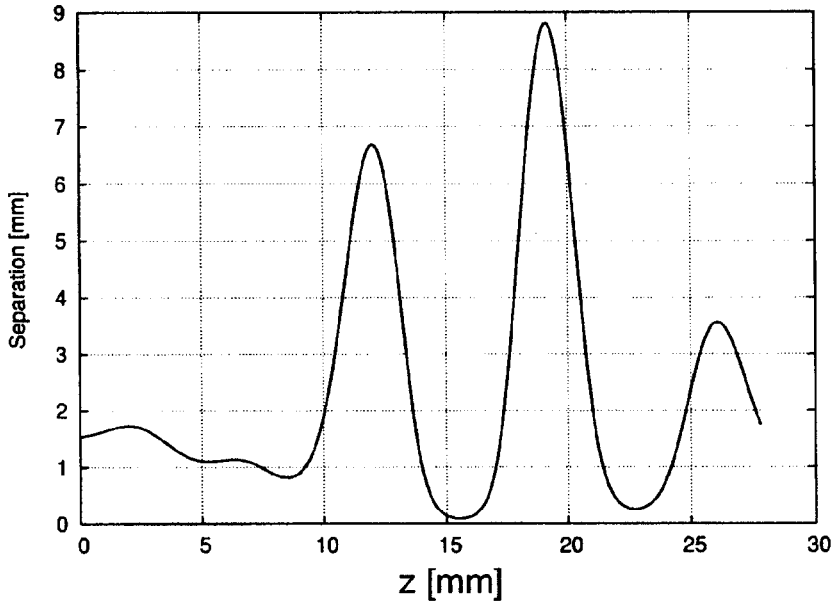
FIG. 15 is a graph showing the distribution of the distance between conductors of the coplanar strip in the reflection-type bandpass filter fabricated in Embodiment 3.

FIG. 15 shows the distribution in the z-axis direction of the distance between conductors s, when using a substrate 2 with a thickness h=1 mm and relative permittivity $\epsilon_r$=24, and when the center conductor width w=1 mm. Table 7 lists the distances between conductors s.

TABLE 7

| Distances between conductors | | | | | | | | | | | | |
|---|---|---|---|---|---|---|---|---|---|---|---|---|
| | z[mm] | | | | | | | | | | | |
| | 0.00 | 0.09 | 0.18 | 0.27 | 0.36 | 0.45 | 0.54 | 0.63 | 0.72 | 0.81 | 0.90 | 0.99 |
| | s[mm] | | | | | | | | | | | |
| | 1.54 | 1.55 | 1.55 | 1.56 | 1.57 | 1.58 | 1.58 | 1.59 | 1.61 | 1.62 | 1.63 | 1.64 |
| #2 | 1.08 | 1.17 | 1.26 | 1.35 | 1.44 | 1.53 | 1.63 | 1.72 | 1.81 | 1.90 | 1.99 | 2.08 |
| — | 1.65 | 1.66 | 1.67 | 1.68 | 1.69 | 1.70 | 1.71 | 1.72 | 1.72 | 1.73 | 1.73 | 1.73 |

TABLE 7-continued

| | Distances between conductors | | | | | | | | | | | |
|---|---|---|---|---|---|---|---|---|---|---|---|---|
| | z[mm] | | | | | | | | | | | |
| | 0.00 | 0.09 | 0.18 | 0.27 | 0.36 | 0.45 | 0.54 | 0.63 | 0.72 | 0.81 | 0.90 | 0.99 |
| | s[mm] | | | | | | | | | | | |
| | 1.54 | 1.55 | 1.55 | 1.56 | 1.57 | 1.58 | 1.58 | 1.59 | 1.61 | 1.62 | 1.63 | 1.64 |
| #3 | 2.17 | 2.26 | 2.35 | 2.44 | 2.53 | 2.62 | 2.71 | 2.80 | 2.89 | 2.98 | 3.07 | 3.16 |
| — | 1.72 | 1.72 | 1.71 | 1.70 | 1.69 | 1.67 | 1.66 | 1.64 | 1.62 | 1.59 | 1.57 | 1.54 |
| #4 | 3.25 | 3.34 | 3.43 | 3.52 | 3.61 | 3.70 | 3.79 | 3.88 | 3.97 | 4.06 | 4.15 | 4.23 |
| — | 1.51 | 1.49 | 1.46 | 1.43 | 1.40 | 1.37 | 1.34 | 1.32 | 1.29 | 1.27 | 1.24 | 1.22 |
| #5 | 4.32 | 4.41 | 4.50 | 4.59 | 4.68 | 4.77 | 4.85 | 4.94 | 5.03 | 5.12 | 5.21 | 5.30 |
| — | 1.20 | 1.18 | 1.17 | 1.15 | 1.14 | 1.13 | 1.12 | 1.11 | 1.11 | 1.10 | 1.10 | 1.10 |
| #6 | 5.39 | 5.47 | 5.56 | 5.65 | 5.74 | 5.83 | 5.92 | 6.00 | 6.09 | 6.18 | 6.27 | 6.36 |
| — | 1.10 | 1.11 | 1.11 | 1.11 | 1.12 | 1.12 | 1.13 | 1.13 | 1.13 | 1.14 | 1.14 | 1.14 |
| #7 | 6.45 | 6.54 | 6.62 | 6.71 | 6.80 | 6.89 | 6.98 | 7.07 | 7.15 | 7.24 | 7.33 | 7.42 |
| — | 1.14 | 1.13 | 1.13 | 1.12 | 1.11 | 1.10 | 1.09 | 1.07 | 1.06 | 1.04 | 1.02 | 1.00 |
| #8 | 7.51 | 7.59 | 7.68 | 7.77 | 7.86 | 7.95 | 8.03 | 8.12 | 8.21 | 8.30 | 8.38 | 8.47 |
| — | 0.98 | 0.96 | 0.94 | 0.92 | 0.90 | 0.88 | 0.86 | 0.85 | 0.84 | 0.83 | 0.82 | 0.82 |
| #9 | 8.56 | 8.65 | 8.73 | 8.82 | 8.91 | 9.00 | 9.08 | 9.17 | 9.26 | 9.35 | 9.44 | 9.53 |
| — | 0.82 | 0.83 | 0.84 | 0.85 | 0.87 | 0.90 | 0.93 | 0.97 | 1.02 | 1.08 | 1.15 | 1.23 |
| #10 | 9.61 | 9.70 | 9.79 | 9.88 | 9.98 | 10.07 | 10.16 | 10.25 | 10.35 | 10.44 | 10.54 | 10.64 |
| — | 1.32 | 1.43 | 1.55 | 1.69 | 1.85 | 2.02 | 2.22 | 2.43 | 2.67 | 2.92 | 3.19 | 3.48 |
| #11 | 10.74 | 10.84 | 10.94 | 11.04 | 11.15 | 11.25 | 11.36 | 11.47 | 11.57 | 11.68 | 11.79 | 11.90 |
| — | 3.79 | 4.11 | 4.43 | 4.76 | 5.08 | 5.40 | 5.70 | 5.97 | 6.21 | 6.41 | 6.56 | 6.65 |
| #12 | 12.01 | 12.12 | 12.23 | 12.34 | 12.45 | 12.56 | 12.66 | 12.77 | 12.87 | 12.97 | 13.07 | 13.17 |
| — | 6.69 | 6.67 | 6.58 | 6.44 | 6.23 | 5.97 | 5.67 | 5.32 | 4.95 | 4.56 | 4.16 | 3.76 |
| #13 | 13.27 | 13.37 | 13.46 | 13.55 | 13.65 | 13.74 | 13.83 | 13.91 | 14.00 | 14.09 | 14.18 | 14.26 |
| — | 3.36 | 2.97 | 2.61 | 2.27 | 1.95 | 1.66 | 1.41 | 1.19 | 1.00 | 0.83 | 0.69 | 0.58 |
| #14 | 14.35 | 14.44 | 14.52 | 14.61 | 14.69 | 14.78 | 14.87 | 14.95 | 15.04 | 15.12 | 15.21 | 15.29 |
| — | 0.48 | 0.40 | 0.34 | 0.29 | 0.24 | 0.21 | 0.18 | 0.16 | 0.14 | 0.13 | 0.11 | 0.11 |
| #15 | 15.38 | 15.46 | 15.55 | 15.63 | 15.72 | 15.81 | 15.89 | 15.98 | 16.06 | 16.15 | 16.23 | 16.32 |
| — | 0.10 | 0.10 | 0.10 | 0.10 | 0.10 | 0.11 | 0.12 | 0.13 | 0.15 | 0.17 | 0.19 | 0.23 |
| #16 | 16.41 | 16.49 | 16.58 | 16.66 | 16.75 | 16.84 | 16.93 | 17.01 | 17.10 | 17.19 | 17.28 | 17.37 |
| — | 0.27 | 0.32 | 0.38 | 0.46 | 0.56 | 0.67 | 0.82 | 0.99 | 1.20 | 1.44 | 1.72 | 2.05 |
| #17 | 17.47 | 17.56 | 17.66 | 17.76 | 17.86 | 17.96 | 18.07 | 18.17 | 18.28 | 18.39 | 18.51 | 18.62 |
| — | 2.42 | 2.82 | 3.27 | 3.75 | 4.26 | 4.79 | 5.34 | 5.88 | 6.42 | 6.94 | 7.42 | 7.85 |
| #18 | 18.74 | 18.85 | 18.97 | 19.09 | 19.20 | 19.32 | 19.44 | 19.55 | 19.67 | 19.78 | 19.89 | 20.00 |
| — | 8.21 | 8.50 | 8.70 | 8.80 | 8.81 | 8.72 | 8.54 | 8.27 | 7.93 | 7.52 | 7.07 | 6.58 |
| #19 | 20.11 | 20.21 | 20.32 | 20.42 | 20.52 | 20.62 | 20.72 | 20.81 | 20.90 | 21.00 | 21.09 | 21.18 |
| — | 6.07 | 5.55 | 5.04 | 4.53 | 4.05 | 3.59 | 3.16 | 2.77 | 2.41 | 2.09 | 1.80 | 1.55 |
| #20 | 21.27 | 21.35 | 21.44 | 21.53 | 21.62 | 21.70 | 21.79 | 21.88 | 21.96 | 22.05 | 22.14 | 22.22 |
| — | 1.33 | 1.14 | 0.08 | 0.84 | 0.73 | 0.63 | 0.56 | 0.49 | 0.44 | 0.39 | 0.36 | 0.33 |
| #21 | 22.31 | 22.39 | 22.48 | 22.57 | 22.65 | 22.74 | 22.82 | 22.91 | 22.99 | 23.08 | 23.17 | 23.25 |
| — | 0.30 | 0.28 | 0.27 | 0.26 | 0.26 | 0.26 | 0.26 | 0.26 | 0.27 | 0.29 | 0.30 | 0.32 |
| #22 | 23.34 | 23.43 | 23.51 | 23.60 | 23.68 | 23.77 | 23.86 | 23.95 | 24.03 | 24.12 | 24.21 | 24.30 |
| — | 0.35 | 0.38 | 0.42 | 0.46 | 0.52 | 0.58 | 0.64 | 0.72 | 0.81 | 0.91 | 1.02 | 1.14 |
| #23 | 24.39 | 24.48 | 24.57 | 24.66 | 24.75 | 24.84 | 24.93 | 25.03 | 25.12 | 25.22 | 25.31 | 25.41 |
| — | 1.28 | 1.42 | 1.58 | 1.74 | 1.91 | 2.08 | 2.26 | 2.43 | 2.61 | 2.77 | 2.93 | 3.07 |
| #24 | 25.50 | 25.60 | 25.70 | 25.80 | 25.89 | 25.99 | 26.09 | 26.19 | 26.29 | 26.38 | 26.48 | 26.58 |
| — | 3.20 | 3.31 | 3.40 | 3.48 | 3.53 | 3.56 | 3.56 | 3.55 | 3.51 | 3.46 | 3.39 | 3.30 |
| #25 | 26.67 | 26.77 | 26.87 | 26.96 | 27.06 | 27.15 | 27.24 | 27.34 | 27.43 | 27.52 | 27.61 | 27.70 |
| — | 3.20 | 3.09 | 2.97 | 2.84 | 2.71 | 2.58 | 2.45 | 2.32 | 2.20 | 2.08 | 1.96 | 1.85 |
| #26 | 27.80 | | | | | | | | | | | |
| — | 1.74 | | | | | | | | | | | |

Figure 16:
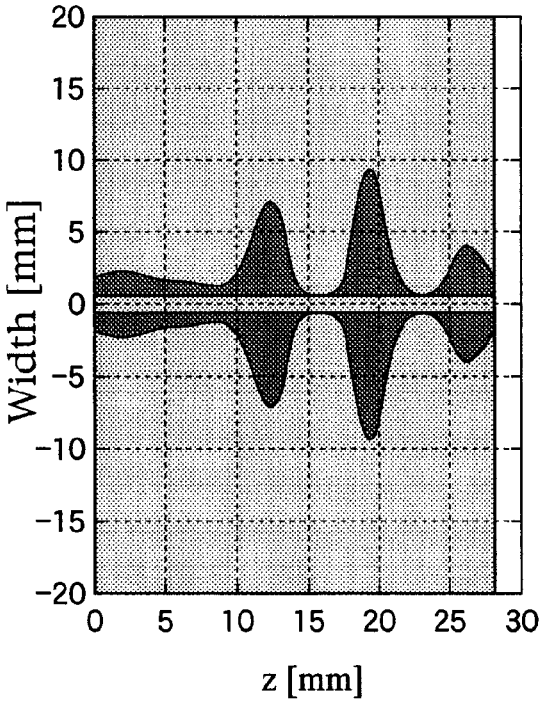
FIG. 16 is a graph showing the shape of the coplanar strip in the reflection-type bandpass filter fabricated in Embodiment 3.

FIG. 16 shows the shape of the coplanar strip in the reflection-type bandpass filter 1 of Embodiment 3. In the figure, the lightly shaded portion represents the center conductor 3 and the side conductors 5*a* and 5*b*, and the heavily shaded portion represents the non-conducting portions 4*a* and 4*b*. A non-reflecting terminator, or an R=50Ω resistance, is provided on the terminating side (the face at z=27.8 mm) of this reflection-type bandpass filter 1. The thicknesses of the metal films of the center conductor 3 and of the side conductors 5*a*, 5*b* are to be thick compared with the skin depth at f=1 GHz. For example, when using copper, the thickness of the center conductor 3 and of the side conductors 5*a*, 5*b* may be 2.1 μm or greater. This bandpass filter 1 is used in a system with a characteristic impedance of 50Ω.

Figure 17:
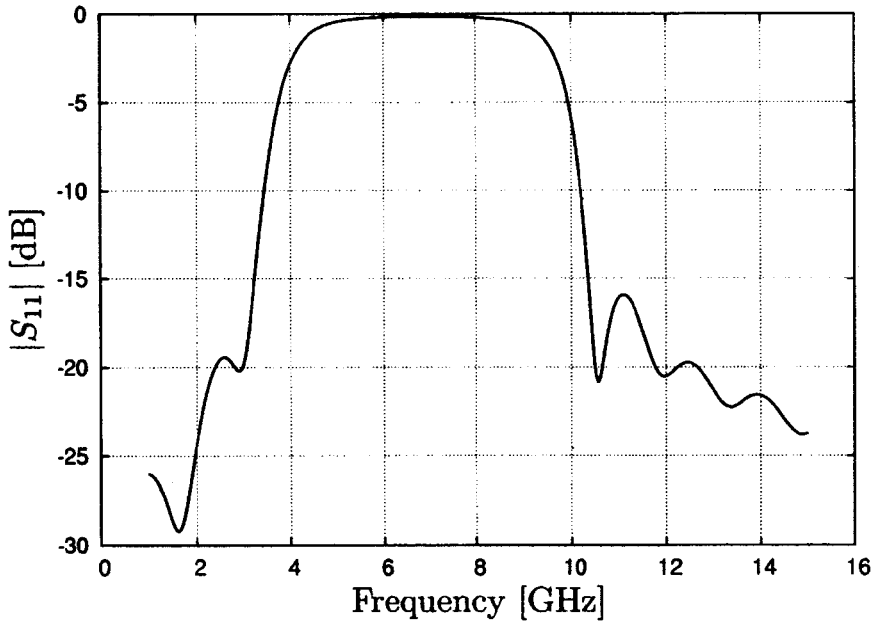
FIG. 17 is a graph showing the reflected wave amplitude characteristic in the reflection-type bandpass filter fabricated in Embodiment 3.
Figure 18:
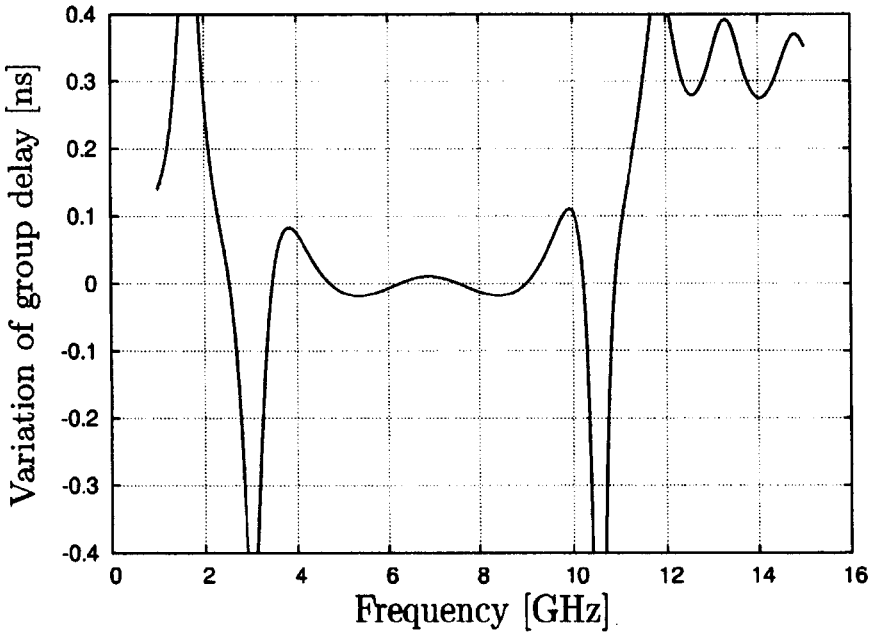
FIG. 18 is a graph showing the reflected wave group delay characteristic in the reflection-type bandpass filter fabricated in Embodiment 3; and, FIG. 19 is an equivalent circuit of a non-uniform transmission line.

FIG. 17 and FIG. 18 show the amplitude characteristic and group delay characteristic respectively of reflected waves ($S_{11}$) in the bandpass filter 1 of Embodiment 3. As shown in the figures, in the range of frequencies f for which 4.1 GHz≦f≦9.5 GHz, the reflectance is −5 dB or greater, and the group delay variation is within ±0.1 ns. In the region f<3.1 GHz or f>10.6 GHz, the reflectance is −15 dB or lower.

In the above, exemplary embodiments of the invention have been explained; but the invention is not limited to these embodiments. Various additions, omissions, substitutions, and other modifications to the configuration can be made, without deviating from the scope of the invention. The invention is not limited by the above explanation, but is limited only by the scope of the attached claims.

What is claimed is:

1. A reflection-type bandpass filter for ultra-wideband wireless data communication, the filter comprising:

a dielectric substrate, a center conductor and plural side conductors provided on both sides of the center conductor, the center conductor and side conductors disposed on a surface of the dielectric substrate with non-conducting portions intervening therebetween, wherein at least one of the center conductor width and the distances between the center conductor and each of the side conductors, is distributed non-uniformly in a length direction of the center conductor;

wherein length-direction distributions of the center conductor width and of the distances between the center conductor and each of the side conductors satisfy a design method based on an inverse problem of deriving a potential from spectral data in the Zakharov-Shabat equation.

2. The reflection-type bandpass filter according to claim 1, wherein the center conductor width is constant, and the distances between the center conductor and each of the side conductors are distributed non-uniformly.

3. The reflection-type bandpass filter according to claim 1, wherein the distances between the center conductor and each of the side conductors are constant, and the center conductor width is distributed non-uniformly.

4. The reflection-type bandpass filter according to claim 1, wherein a difference between a reflectance of the filter in a range of frequencies f for which $f<3.1$ GHz and $f>10.6$ GHz, and a reflectance in a range of frequencies for which 3.9 GHz$\leqq f \leqq$9.8 GHz, is 10 dB or greater, and wherein, in the range 3.9 GHz$\leqq f \leqq$9.8 GHz, a group delay variation is within ±0.1 ns.

5. The reflection-type bandpass filter according to claim 1, wherein a difference between a reflectance in a range of frequencies f for which $f<3.1$ GHz and $f>10.6$ GHz, and a reflectance in a range of frequencies for which 3.7 GHz$\leqq f \leqq$10.0 GHz, is 10 dB or greater, and wherein, in the range 3.7 GHz$\leqq f \leqq$10.0 GHz, a group delay variation is within ±0.1 ns.

6. The reflection-type bandpass filter according to claim 1, wherein a difference between a reflectance in a range of frequencies f for which $f<3.1$ GHz and $f>10.6$ GHz, and a reflectance in a range of frequencies for which 4.1 GHz$\leqq f \leqq$9.5 GHz, is 10 dB or greater, and wherein, in the range 4.1 GHz$\leqq f \leqq$9.5 GHz, a group delay variation is within ±0.1 ns.

7. The reflection-type bandpass filter according to claim 1, wherein a characteristic impedance Zc of an input terminal transmission line of the reflection-type bandpass filter satisfies the inequality: $10\Omega \leqq Zc \leqq 300\Omega$.

8. The reflection-type bandpass filter according to claim 7, further comprising, on a terminating side, one of:

a resistance, coupled to the terminating side, having the same impedance as said characteristic impedance Zc, and a non-reflecting terminator.

9. The reflection-type bandpass filter according to claim 1, wherein the center conductor and the side conductors comprise metal plates of a thickness equal to or greater than a skin depth of the metal plates at a frequency f=1 GHz.

10. The reflection-type bandpass filter according to claim 1, wherein the dielectric substrate has a of thickness h in a range 0.1 mm$\leqq h \leqq$10 mm, a relative permittivity $\in_r$ in a range $1 \leqq \in_r \leqq 500$, a width W in a range 2 mm$\leqq W \leqq$100 mm, and a length L in a range 2 mm$\leqq L \leqq$500 mm.

11. The reflection-type bandpass filter according to claim 1, wherein the length-direction distributions of the center conductor width and of the distances between the center conductor and each of the side conductors satisfy a window function method.

12. The reflection-type bandpass filter according to claim 1, wherein the length-direction distributions of the center conductor width and of the distances between the center conductor and each of the side conductors satisfy a Kaiser window function method.

* * * * *